US012753678B2

(12) United States Patent
Stonestreet et al.

(10) Patent No.: US 12,753,678 B2
(45) Date of Patent: Oct. 6, 2026

(54) SYSTEMS AND METHODS FOR ATTACHED-ANCHORED CASING STUB REPAIR

(71) Applicant: Saudi Arabian Oil Company, Dhahran (SA)

(72) Inventors: David Butler Stonestreet, Dhahran (SA); Faris Abdullah Al Qahtani, Buqayq City (SA); Salahaldeen Saleh Almasmoom, Dammam City (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/012,080

(22) Filed: Jan. 7, 2025

(65) Prior Publication Data

US 2026/0193966 A1 Jul. 9, 2026

(51) Int. Cl.

| | |
|---|---|
| ***E21B 43/10*** | (2006.01) |
| ***E21B 23/01*** | (2006.01) |
| ***E21B 23/06*** | (2006.01) |
| ***E21B 33/12*** | (2006.01) |

(52) U.S. Cl.

CPC ..... *E21B 43/10* (2013.01); *E21B 23/01* (2013.01); *E21B 23/06* (2013.01); *E21B 33/1208* (2013.01)

(58) Field of Classification Search

CPC ..... E21B 43/10; E21B 23/01; E21B 23/06; E21B 33/1208; E21B 31/18; E21B 4/18; E21B 43/103

See application file for complete search history.

(56) References Cited

U.S. PATENT DOCUMENTS

| | | | | |
|---|---|---|---|---|
| 4,660,863 | A | 4/1987 | Bailey et al. | |
| 5,829,524 | A | 11/1998 | Flanders et al. | |
| 7,562,714 | B2 | 7/2009 | Lynde | |
| 9,512,691 | B2 | 12/2016 | Nutley et al. | |
| 10,081,998 | B2 | 9/2018 | Tunget | |
| 12,503,922 | B2 * | 12/2025 | Almasmoom | E21B 17/08 |
| 2008/0053656 | A1 * | 3/2008 | Lynde | E21B 33/1208 166/277 |
| 2008/0217000 | A1 | 9/2008 | Palmer et al. | |
| 2008/0217014 | A1 * | 9/2008 | Lynde | E21B 31/18 166/301 |
| 2016/0010411 | A1 * | 1/2016 | Al-Rabeh | E21B 23/06 166/387 |
| 2019/0010786 | A1 * | 1/2019 | Durst | E21B 41/0042 |
| 2021/0270103 | A1 * | 9/2021 | Greci | E21B 31/18 |
| 2022/0372839 | A1 | 11/2022 | Almajed et al. | |
| 2025/0163763 | A1 * | 5/2025 | Almasmoom | E21B 17/08 |

FOREIGN PATENT DOCUMENTS

WO WO-2019158922 A1 * 8/2019 ..... E21B 23/06

* cited by examiner

*Primary Examiner* — Daniel P Stephenson
(74) *Attorney, Agent, or Firm* — Fish & Richardson P.C.

(57) ABSTRACT

A method for deploying an attached-anchored stub connector is disclosed. The method includes receiving a slack off force in a first direction of about 5 kilopounds (klbs) to about 15 klb. This step includes receiving a milled casing stub in an overshot section of the stub connector, and attaching, by an attachment arrangement of an overshot section of the stub connector, to the casing stub. The method also includes receiving an overpull force in a second direction opposite the first direction of about 5 klb to about 10 klb. This step includes anchoring, by an anchoring packer of the stub connector, to the wellbore casing.

22 Claims, 13 Drawing Sheets

SYSTEMS AND METHODS FOR ATTACHED-ANCHORED CASING STUB REPAIR

TECHNICAL FIELD

This disclosure relates to system, assemblies, methods and devices for connecting replacement casings to a long-string casing stub cemented in a wellbore.

BACKGROUND OF THE INVENTION

Wellbore completion operations mount an inner casing to the walls of a wellbore or outer casing. In a long-string cemented casing completion system ("long-string system"), a unitary inner casing extends from the bottom of the wellbore extending all the way to the surface. A tubing hanger setting in a tubing spool lands and isolates an upper annular space outside the unitary inner casing from a lower annular space outside the unitary inner casing. The lower unitary inner casing is then cemented by pumping the cement through the entire long-string and displacing the cement into the lower annular space between the inner casing and an outer casing by flowing a fluid (e.g., drilling fluid or completion fluid (brine) with same mud weight through the entire inner casing as the drilling fluid). High efficiency wiper plugs wipe the inner surface of the casing. The formed cement slab includes a column surrounding downhole portion of the unitary inner casing.

In "upper and lower" completion systems ("upper/lower systems"), a lower inner is run through a wellbore and hung in an outer casing by a liner hanger. The lower inner casing is then cemented in place to the liner hanger depth. An upper liner casing is then run into the wellbore and sealed to the lower inner casing. The upper inner casing can include production tubing with production tubulars (e.g., production packer, or seals).

SUMMARY OF THE INVENTION

In certain aspects, a method for deploying an attached-anchored stub connector includes receiving a slack off force in a first direction of about 5 kilopounds (klbs) to about 15 klb. Receiving the slack off force includes receiving a milled casing stub in an overshot section of the stub connector, and attaching, by an attachment arrangement of an overshot section of the stub connector, to the casing stub. The method also includes receiving an overpull force in a second direction opposite the first direction of about 5 klb to about 10 klb. Receiving the overpull force includes anchoring, by an anchoring packer of the stub connector, to the wellbore casing.

In some cases, attaching, by the attachment arrangement of the overshot section of the stub connector, to the casing stub comprises sealing, by at least one seal of the overshot section of the stub connector, the casing stub to seal the stub connector to an outer surface of the casing stub.

In some methods, attaching, by the attachment arrangement of the overshot section of the stub connector, to the casing stub includes engaging, by a slip of the overshot section of the stub connector, the casing stub to affix the stub connector to the casing stub. Attaching, by the attachment arrangement of the overshot section of the stub connector, to the casing stub can include sealing, by at least one seal of the overshot section of the stub connector, the casing stub to seal the stub connector to an outer surface of the casing stub.

The method can also include receiving, by a polished bore receptacle of the stub connector, a long-string replacement casing.

In some methods, the slack off force moves the stub connector towards the unattached casing stub.

In some cases, the overpull force pulls the stub connector away from the attached casing stub.

In certain aspects, a method includes aligning, by a running tool, a stub connector of a long-string remedial assembly releasably connected to the running tool, and applying a slack off force to the stub connector to attach the stub connector to the casing stub. The slack off section has a set of deformable seals and a slip. The method also includes applying an overpull force to the attached stub connector and maintaining the overpull force while the attached stub connector is anchored to a wellbore casing.

In some methods, the slack off force is about 5 klb to about 15 klb.

In some cases, the overpull force is about 5 klb to about 10 klb.

Some methods also include releasing the overpull force after the stub connector is anchored to the wellbore casing.

The method can also include releasing engagement with the attached-anchored stub connector.

In certain aspects, a connection device includes a body extending from a first end to a second end. The first end and second end define a body axis. The body has an overshot section a polished bore receptacle (PBR), and an anchoring arrangement. The overshot section is arranged at the second end. The overshot section includes a guide wall having a lip. The lip defines an opening at the second end of the body. An inner surface of the guide wall at least partially defines a channel extending from the opening towards the first end of the body. The overshot section also includes an attachment arrangement having a seal stack and a permanent slip. The seal stack is mounted to the inner surface of the guide wall. The seal stack defines an aperture having a seal diameter less than the lip diameter. The permanent slip is mounted to the inner surface of the wall guide. The permanent slip defines a hole having a slip diameter that is less than the lip diameter. The seal stack is arranged between the permanent slip and the opening of the lip. The PBR is arranged between the first end and the overshot portion. The anchoring arrangement is arranged between the first end and the overshot portion.

Some connection devices also include a computer subsystem having a controller, one or more processors, and a non-transitory computer-readable medium for storing instructions executable by the one or more processors to perform operations. The operations can include determining a slack off load and an overpull load, prompting a running tool attached to the first end of the connector to apply the slack off load, and prompting the running tool attached to the first end of the connector to apply the overpull load. Some operations also include determining a baseline weight. In some connection devices, prompting operations prompting the anchoring arrangement to anchor the connector while the overpull load is applied.

In some connection devices, the lip opening, seal aperture, and slip hole are aligned on the body axis.

The PBR can be arranged between the overshot section and the anchoring arrangement. Some anchoring arrangements have a permanent, expandable packer.

In some connection devices, the anchoring arrangement is arranged between the overshot section and the PBR. The anchoring arrangement can include a retrievable, expandable packer.

The first end can define a first opening sized to receive a replacement casing. The lip opening at the second end can be sized to receive a casing stub.

This disclosure relates to methods and systems for installing an attached-anchored stub repair completion system. The stub repair system includes a connector device with a polished bore receptacle (PBR) facing uphole and overshot section facing downhole when deployed in a wellbore. The connector device receives a casing stub in the overshot section. A sealing arrangement (with a molded seal stack and a slip) in the overshot section attaches and seals the device to the casing stub. The connection device also includes a packer operable to expand and form an annular seal between the device and the wellbore casing. The packer can be arranged between the PBR and the overshot section or the PBR can be arranged between the packer and the overshot section.

To install the attached-anchored stub repair system, the connector device is run into a wellbore with a prepared casing stub. The device is aligned with the casing stub and pressed downhole onto the casing stub by a force of about 10 klb to insert the casing stub into the overshot section of the connection device. During insertion, the slip grips the stub, and the molded seal stack forms a seal with the casing stub. The device is then pulled uphole by about 5-10 klb to confirm the slips are fully engaged. A packer expands and anchors the device to the wellbore casing. The running tool is disconnected and removed. A replacement casing can be inserted and sealed to the PBR of the connection device.

The packer and sealing arrangement of the stub connector device can reduce leaks between the casings and wellbore annulus and can mitigate the effects of a leak. For example, the packer and sealing arrangement may reduce or prevent the development of casing-casing annulus pressure, restrict replacement casing movement within the polished bore receptacle, and fluidically seal off a leak from other areas of the wellbore.

The term "attached" recited herein refers to a sealed connection between a casing stub and a stub connector. The sealed connection results from the engagement between an attachment arrangement, for example a seal stack, slips, and a casing stub.

The term "anchored" recited herein refers to the connection between an anchoring arrangement, for example an expandable packer, of a connection device or stub connector and an outer wellbore boundary, for example an outer wellbore casing or the walls of a wellbore.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
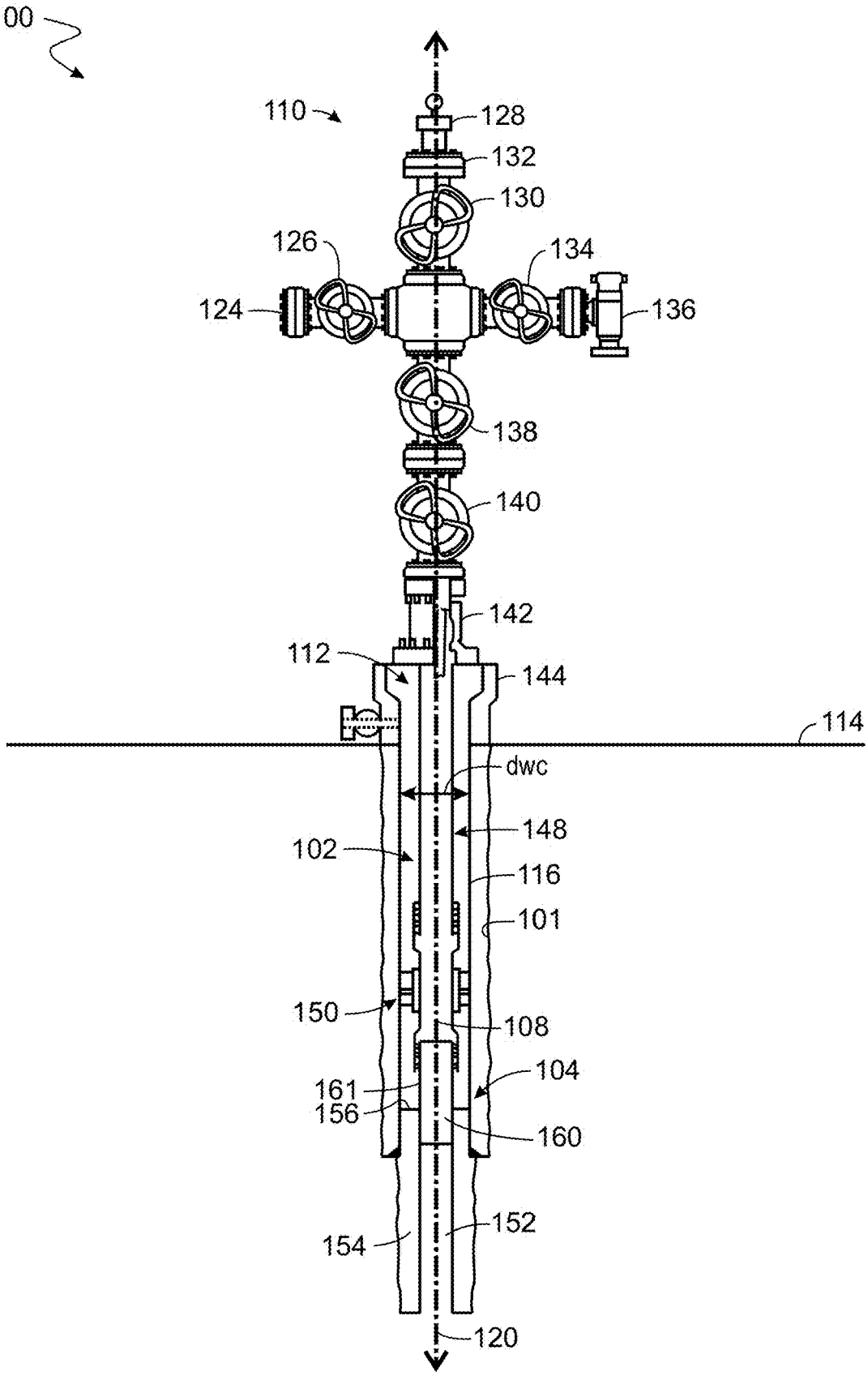
FIG. 1 is a cross-sectional front view of a casing repair system with a stub connector sealed to a casing stub and a replacement casing.

This disclosure relates to a long-string casing system with an attached-anchored remedial assembly and methods for installing the attached-anchored remedial assembly onto a milled, long-string casing stub. The remedial attached-anchored assembly includes an attached-anchored stub connector (connection device) and a replacement (new) casing attachable to the stub connector. The stub connector includes a casing receiving (first, uphole) end and a stub receiving (second, downhole) end. The stub connector includes a polished bore receptacle at the uphole end sized to receive a replacement casing, and an overshot section at the downhole end sized to receive a long-string casing stub. The stub connector also includes an anchoring packer between the overshot section and the first end of the stub connector. The overshot section includes an attachment arrangement for mounting and sealing the casing stub the stub connector. The attachment arrangement includes a compressible seal stack and a grapple (permanent slip). When the stub connector is fully deployed, the attachment arrangement fluidically seals and mechanically affixes the stub connector to the casing stub such that the stub connector is an "attached" stub connector. When the stub connector is fully deployed, the anchoring arrangement expands to mount the stub connector to the walls or casing lining of the wellbore such that the stub connector is an "anchored" stub connector.

The remedial assembly with an attached-anchored stub connector can be used when a long-string casing in a long-string completed well is faulty (e.g., leaking, corroded, or otherwise damaged). If the damaged region of the long-string casing is above a cement column, the damaged region, and the engine casing uphole of the damaged region can be cut, separated and removed from the wellbore, leaving a long-string casing stub protruding from the cement column. After the stub is milled, the remedial assembly is be deployed to attach a new casing to the stub so that production of the well can continue. The stub connector is aligned with the casing stub and weight measurements are taken to determine a slack off force and overpull force. The connector is pressed (downhole) onto the casing stub by applying the determined slack off force to the connector by a running tool. The overshot section of the connector receives the casing stub and seal stack compressed as the casing stub moves deeper into the overshot section of the stub connector.

As the casing stub reaches the grapple in the overshot section, the grapple attaches to the casing stub and engages the casing stub. The engagement between the grapple and the casing stub permanently affixes the casing stub to the stub connector. The compressed seal stack contacts the exterior surface of the casing stub to fluidically seal the casing stub to the slack off section of the stub connector. To confirm that the grapple is properly engaged, the running tool applies the determined overpull (uphole) force to the stub connector, and if engaged, the casing stub. While the overpull force is maintained on the stub connector, the anchoring packer is actuated to expand and anchor the stub connector to the wellbore. The overpull force is terminated and the stub connector is in the "attached-anchored" state. In this state, the replacement casing of the remedial assembly can be run-in-hole and attached to the polished bore receptacle by a stinger arrangement of the replacement casing.

The expanded packer separates and fluidly isolates an annular space of the wellbore into an uphole annular space aligned with the new casing and downhole annular space aligned with the casing stub. In this configuration, the attached-anchored stub connector may reduce or prevent the development of a casing-casing annulus pressure if the casing stub further leaks or corrodes by fluidically isolating the downhole annular space. Additionally, the attached-anchored stub connector may reduce or prevent the development of a casing-casing annulus pressure if the overshot section of the stub connector leaks by fluidically isolating the downhole annular space. The attached-anchored stub connector may also reduce the occurrence of leaks in the original long-string casing and in a replacement casing because the anchored packer restricts long-string casing movement and the PBR may absorb at least some movement of the replacement casing. The packer, unexpanded, has a large diameter and forms the widest section of the stub connector. The unexpanded packer can improve alignment by centralizing the stub connector as the stub connector is run is hole. The unexpanded packer can reduce or prevent misalignment with the overshot portion and reduce the risk of the casing stub damaging the seals upon insertion.

FIG. 1 is a cross-sectional front view of a long-string casing system 100 in a wellbore 101 with a remedial assembly 102 and a modified long-string completion 104. The remedial assembly 102 is mounted onto the modified long-string completion 104 so that the remedial assembly 102 and the modified long-string completion 104 form an isolated fluid path 108 through the wellbore 101.

The long-string casing system 100 includes a Christmas tree apparatus 110 at a wellbore opening 112 at a surface 114. A wellbore casing 116 of the system 100 lines walls 118 of the wellbore 101. The wellbore casing 116 has a wellbore casing diameter $d_{wc}$. The wellbore 101 defines a wellbore axis 120. The Christmas tree apparatus 110 includes a kill wing valve 122, a kill wing connection 124, a tree cap 126 with a gauge 128, a swab valve 130, a tree adapter 132, a production wing valve 134, a surface choke 136, an upper master valve 138, a lower master valve 140, and a tubing-header adapter 142. The surface choke 136 can connect to production facilities (not shown). The tubing header adapter 142 connects to a production string 144.

The remedial assembly 102 includes a replacement casing 148 and an attached-anchored stub connector 150. The stub connector 150 mounts and seals the remedial assembly to the modified long-string casing completion 104.

The long-string casing completion 104 also includes an original long-string casing 152 mounted in a cement column 154. The cement column 154 has a face 156 oriented uphole. The original long-string casing 152 includes a milled casing stub 160 that protrudes from the cement column 154. The casing stub 160 is centered on the wellbore axis 120. The casing stub 160 is inserted into the stub connector 150 to connect the modified long-string casing completion 104 to the remedial assembly 102. The casing stub 160 has an exterior surface 161 on which the remedial assembly 102 is mounted.

Figure 2:
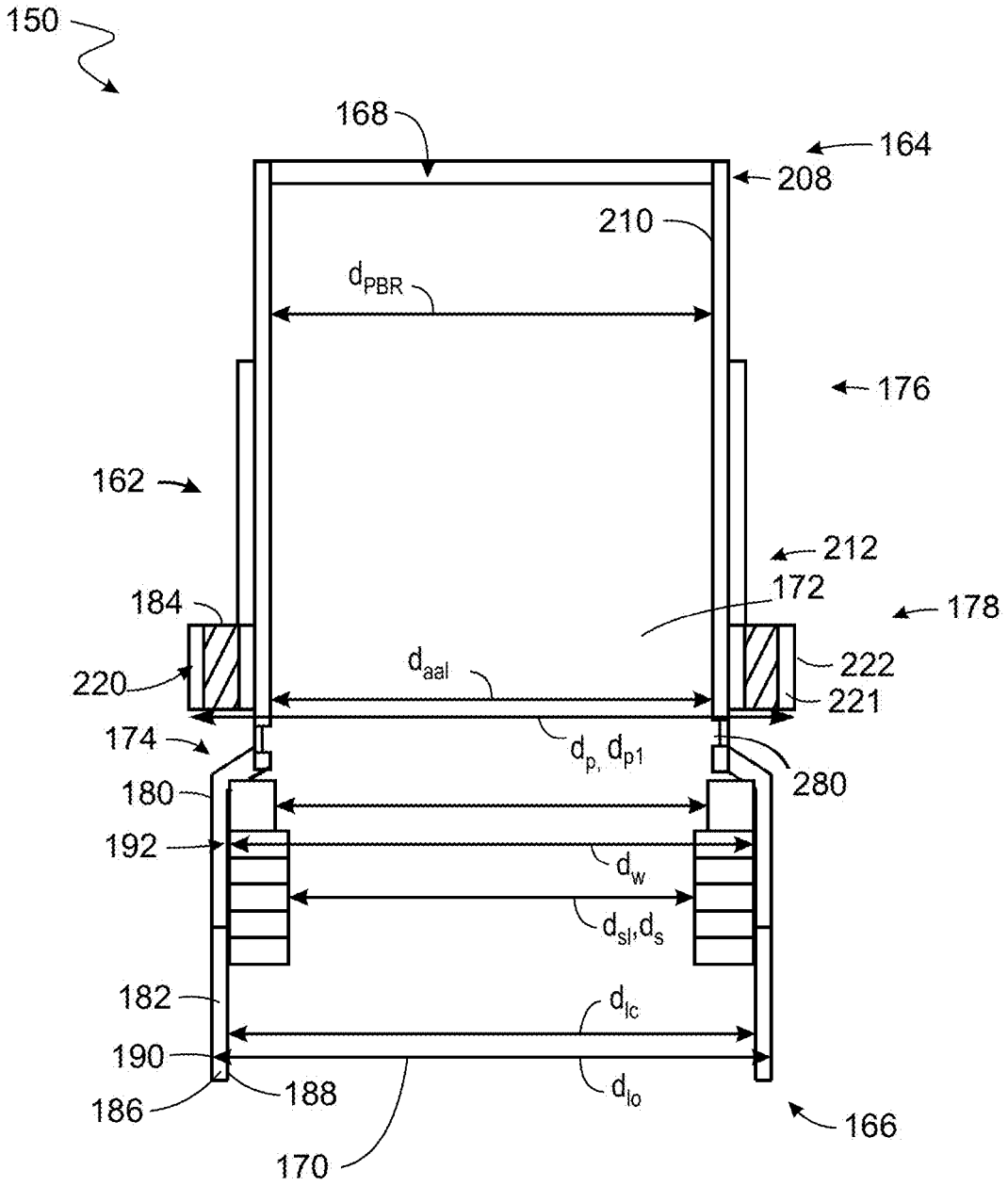
FIG. 2 is a cross-sectional front view of the stub connector with a polished bore receptable, an anchor arrangement, and an overshot section.

FIG. 2 is a cross-sectional front view of the stub connector 150 of the remedial assembly 102. The stub connector 150 has a body 162 extending from a first (uphole) end 164 to a second (downhole) end 166. The first end 164 defines a first opening 168 sized to receive a replacement casing 148. The second end 166 defines a second opening 170 sized to receive the casing stub 160. A channel 172 extends from the first opening 168 to the second opening 168. The channel 172 can fluidly connect the to the replacement casing 148 and the casing stub 160 to form the fluid path 108 (FIG. 1) along the wellbore axis 120.

The body 162 of the stub connector 150 includes an overshot section 174 at the second end of the body 162, a polished bore receptacle (PBR) 176, and an anchoring arrangement 178. The PBR 176 is arranged between the overshot section 174 and the anchoring arrangement 178. The overshot section 174, polished bore receptacle 176, and anchoring arrangement 178 are aligned with and centered on the wellbore axis 120. In some cases, the first end and second end of the body define a body axis. The overshot section, PBR, and anchoring arrangement may be aligned with and centered on the body axis. The overshot section 174, polished bore receptacle 176, and anchoring arrangement 178 at least partially define the channel 172.

The overshot section 174 includes a wall 180 with a guide lip 182. The wall 180 attaches at first (connected) end 184 to the PBR 176 and extends to a free end 186. The free end 186 forms the second end 166 of the body 162 of the stub connector 150. An inner surface 188 of the guide lip 182 at the free end 186 of the wall 180 defines the second opening 170. The inner surface 188 of the guide lip 182 has an inner lip diameter $d_{li}$. The guide lip 182 also has an outer surface 190 with an outer lip diameter $d_{lo}$. The inner lip diameter $d_{li}$ is greater than an outer diameter $d_{so}$ (FIG. 3) of the casing stub 160. The guide lip 182 guides the casing stub towards an attachment arrangement 192 mounted to the inner surface 188 of the wall 180 when the casing stub 160 is inserted into the overshot section 174.

The overshot section 174 includes the attachment arrangement 194 for sealing and affixing the stub connector to the casing stub 160. The attachment arrangement 194 includes a seal stack 196 formed by a set of individual, compressible, adjacent (stacked) seal rings 198. The attached arrangement also includes a permanent slip 200 (grapple). In use, the seal stack 196 forms a fluid seal with the casing stub 160 and the permanent slip permanently mounts the stub connector 150 to the casing stub 160. The permanent slip engages the casing stub 160 such that the stub connector is axially constrained and rotationally constrained to the casing stub 160.

The seal stack 196 extends along the inner surface 188 of the wall 180. The seal stack 196 defines an aperture 202 with a relaxed (uncompressed) seal diameter $d_{s1}$ in the relaxed state of the seal stack 196. The seal stack 196 and the aperture 202 are centered on the wellbore axis 120 (or the body axis). In use, the seal stack 196 compresses to receive the casing stub 160 when a slack off force is applied the stub connector. When engaged with the casing stub 160, in the compressed state, the aperture 202 defined by the seal stack 196, has a compressed seal diameter $d_{s2}$. The relaxed seal diameter is less than the compressed seal diameter. The compressed and relaxed seal diameters are less than the lip diameter.

The permanent slip 200 is arranged on the inner surface 188 of the wall 180. The permanent slip 200 has a disengaged position and an irreversible engaged position. prior to the insertion of the casing stub 160 into the overshot section 174, the permanent slip 200 is in the disengaged position. The permanent slip 200 can move from the disengaged position to the engagement position but cannot move from the engaged position to the disengaged position. The permanent slip 200 is a hydraulically actuated slip type.

The slip 200 defines a hole with a disengaged slip diameter $d_{ps1}$ in the disengaged position and an engaged slip diameter $d_{sp2}$ in the engaged position. The disengaged slip diameter is greater than the engaged slip diameter. In some cases, the disengaged slip diameter is equal to the engaged slip diameter. The permanent slip 200 moves from the disengaged to the engaged position upon due to movement of the casing stub 160 within the overshot section 174. For example, the uphole movement of the casing stub 160 relative to the stub connector 150 (or the downhole movement of the stub connector 150 relative to the casing stub 160), moves the casing stub 160 into the overshot section 174, then deeper into the overshot section 174. A rim 204 of the casing stub (FIG. 3) radially aligns with the slip 200 and the slip 200 latches to the rim 204. In some cases, the stub includes a shoulder. The casing stub can latch onto the shoulder or an area adjacent the shoulder or rim on the exterior surface of the casing stub. The slip can engage the casing stub by mainly grapple, teeth, or any other known latching structure. The slip(s) 200 engage the casing stub after the seal stack 196 pressure seals and fluidically seals the casing stub 160 to the stub connector 150, creating a closed fluid and pressure system. When certain pressure is applied at surface, a sleeve connected to the slip 200 moves uphole, which forces the slips 200 to move uphole and engage to the casing stub 160. Some overshot sections 174 include multiple slips, for example, 3 slips, 4 slips, 5 slips, 6 slips, 7 slips, 8 slips, 9 slips, or 10 slips. The multiple slips can be arranged in sets of 2, each set arranged equidistant around the inner surface 188 of the wall 180 with gaps between each set of slips. The slips can have thread-type teeth, for example, 3, 4, or 5 thread type teeth, that engage the casing stub 160. The threads of the thread-type teeth may point downwards (downhole, towards the casing stub and second downhole end). Downward facing threads may avoid or lessen a downhole movement of the stub connector during testing, for example, movement caused by the hydraulic pressure applied uphole of the packer during pressure testing, production, or similar operations.

The permanent slip 200 is arranged shallower (above, uphole of the seal stack) within the overshot section 174 than the seal stack 196. In this configuration, each seal 198 in seal stack 196 contacts and seals the stub connector 150 to the exterior surface 161 of the casing stub 160 before the stub connector is affixed to the casing stub 160. The slip 200 is arranged directly adjacent (uphole) of the seal stack 196 so that the rim 204 (FIG. 3) or outer surface 161 of the casing stub 160 interacts with the permanent slip 200 after passing through (compressing) the seal stack 196 and after a hydraulic pressure is applied at the surface to move the slips 200 into engagement with the casing stub 160.

The polished bore receptacle (PBR) 176 is a smooth, tight-tolerance pipe with a honed internal diameter surface 206 for landing sealing assemblies of production tubing (e.g., the replacement casing 148 of the remedial assembly 102) inserted into at least a portion of the PBR 176. During manufacturing, polished bore receptacles a specific gas nitrating process is applied to the PBR, which creates a hardened and non-corrosion finish to the inner diameter surface 206 of the PBR. This does not affect diameter tolerances or separate during thermal material movements. The hardness allows for drilling tools to pass or rotate through the PBR without damaging the inner surface.

The PBR 176 has a sealing (first) end 210 oriented towards the first end 164 of the connector 150 (uphole). The inner diameter surface 106 at the sealing end 210 defines the first opening 168 of the connector 150. The inner diameter surface 206 at least partially defines the channel 171. The first opening 168 and the inner diameter surface 206 are sized and shaped to receive the replacement casing 148 of the remedial assembly 102.

The PBR 176 has a connector (second) end 212 oriented towards the second end 166 of the connector 150 (downhole). The second end 212 is attached to or integral with the anchoring arrangement 194. In some cases, the connection end of the PBR is attached to or integral with the attachment arrangement and the anchoring arrangement is mounted the exterior of the PBR.

Figure 3:
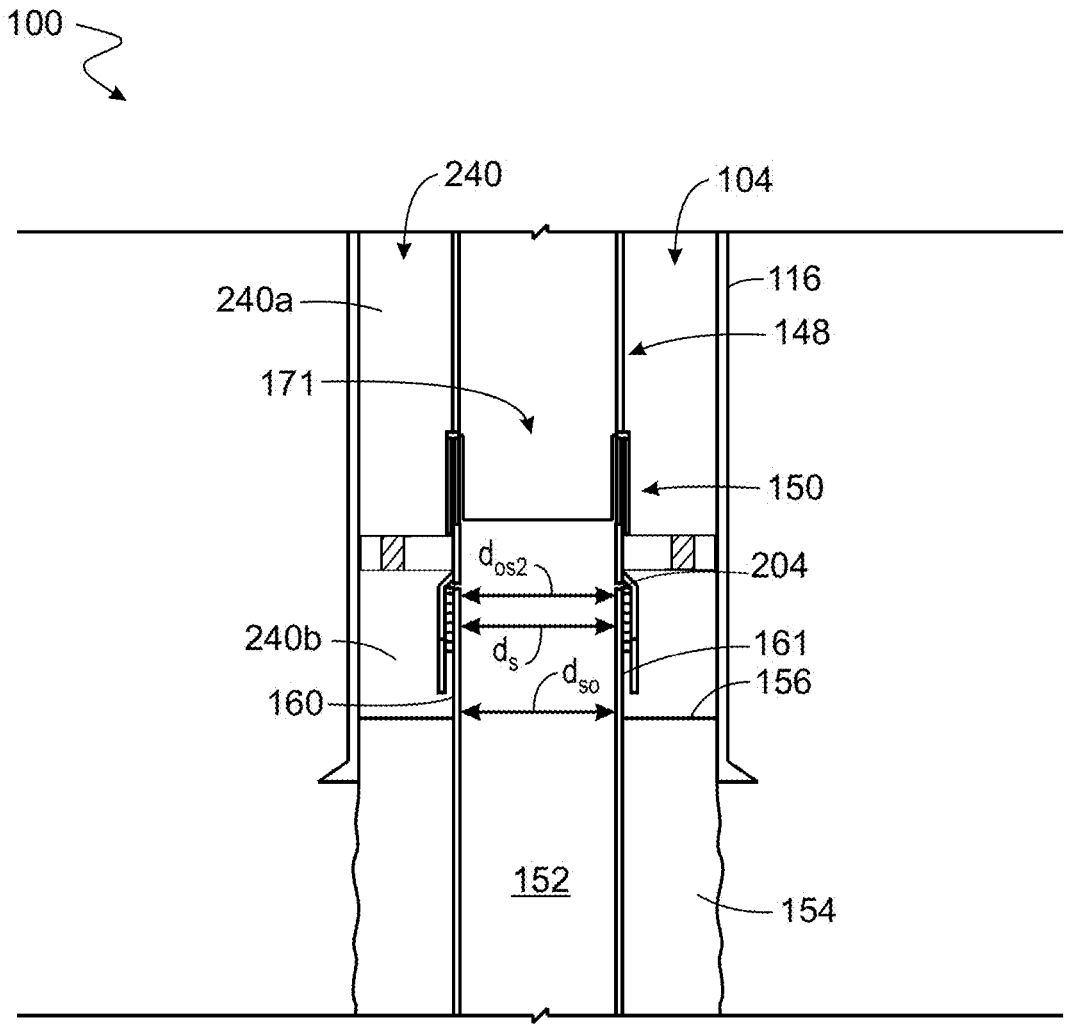
FIG. 3 is a cross-sectional front view of the overshot section of the stub connector engaged with the casing stub in a wellbore.

The anchoring arrangement 178 includes a permanent packer 220 arranged between the PBR 176 and the attachment arrangement 194. The permanent packer includes a packer sealing element (e.g., rubber element, seal, rubber surface) 221 with an external face 222 that defines a packer diameter $d_p$. The permanent packer 220 also includes a packer slip 224 that is operable to press the packer seal 221 radially outwards, towards a casing of the wellbore. The packer 220 has a contracted position and an expanded (anchored) position (FIG. 3). The position of the packer 220 is controlled by the packer slip 224. In the contracted position, the permanent packer 220 has a contracted diameter, $d_{p1}$. In the expanded position, the packer has an expanded diameter $d_{p2}$ (FIG. 3). The expanded diameter may be equal to the wellbore casing diameter $d_{wc}$. In some cases, the anchoring arrangement includes a retrievable packer. In some stub connectors, the anchoring arrangement is the permanent packer or the retrievable packer. The contract diameter $d_{p1}$ of the packer 220 is greater than the outer diameter of the wall 180 of the attachment arrangement 194. The packer 220, in the contracted or expanded position, defines or forms the widest region of the stub connector 150. The packer 220 can operate as a passive centering structure during insertion of the connector 150 to orient the connector 150 along the wellbore axis 120 and to passively align the overshot section 174 with the casing stub 160 when the packer 220 is in the contracted position.

To actuate the packer slip 224 to move the packer from the contracted position to the expanded position, a surface pressure of about +/−10% of a pre-designed hydraulic pressure is applied to the inside of the packer. The surface pressure moves a sleeve (not shown) of the packer to push the packer slips 224 to move radially outwards The sleeve continues to move with either increasing the applied pressure inside the packer 220, or by applying +/−10% of a pre-designed downwards weight to push the rubber element 221 of the packer 220 to engage to the wall of the casing. In the packer 220, the seal element 221 moves under the force of the slip 224 to expand and seal the packer 220 to the casing.

FIG. 3 is a cross-sectional front view of the attached-anchored stub connector 150 with the attachment arrangement 194 in the attached position and the anchoring arrangement 178 in the anchored, expanded position. The attached position, the attached arrangement 194 of the overshot section 174 is affixed to and in sealed connection with the casing stub 160. In the anchored position, the anchoring arrangement 178 is engaged and sealed to the wellbore casing 116. The replacement casing 148 of the remedial assembly 102 is connected to a sealed with the PBR 176 such that the stub connector 150 fluidly connects the modified long-string casing 152 to the replacement casing 148 by the casing stub 160 and the stub connector 150. The casing stub 160, stub connector 150, and replacement casing 148 are fluidically sealed to each other and form the isolated fluid path (conduit) 108. The isolated fluid path 108 is at least partially formed by the channel 171 of the stub connector 150.

A wellbore annulus 240 is defined between the wellbore casing 116 and the body 162 of the casing stub, the replacement casing 148, and the casing stub 160, collectively. The wellbore annulus 240 extends from the surface to the face 156 of the cement column 154. In the anchored position, the packer 220 divides or separates a wellbore annulus 240 into an uphole (first) region 240*a* and a downhole (second) region 240*b*. The uphole region 240*a* of the wellbore annulus 240 extends uphole from the packer 220. The downhole region 240*b* of the wellbore annulus 240 extends downhole from the packer 220, to the face 156 of the cement column 154. The uphole region 240*a* and the downhole region 240*b* are fluidically isolated by the packer 220. In this configuration, the packer 220 isolates the uphole region 240*a* of the wellbore annulus 240 from leaks than may develop in the casing stub 160 or overshot section 174, thereby mitigating the effects of a leak in the downhole region 240*b* on production operations.

FIGS. 4A-4I are cross-sectional front views of the remedial assembly 102 being deployed in a long-string completion 246. A rig 248 is arranged at the surface for replacing a damaged long-string pipeline 250 (damaged long string casing) of the long string completion 246. The rig 248 includes and/or connects to sensors and gauges 252 installed at surface. The sensors and gauges 252 can detect downhole changes in the long string completion 246.

The rig 248 includes and/or is operably connected to a computer sub-system 254 such that the computer sub-system 254 can control the rig 248. The computer sub-system has a controller, one or more processors, and a non-transitory computer-readable medium for storing instructions executable by the one or more processors to perform operations. The operations can include determining a slack off load and an overpull load, prompting a running tool attached to the first end of the connector to apply the slack off load, and prompting the running tool attached to the first end of the connector to apply the overpull load. Some operations also include determining a baseline weight. In some connection devices, prompting operations prompting the anchoring arrangement to anchor the connector while the overpull load is applied.

The rig 248 includes a fluid pump connected to the long string casing completion and operable to pump fluid into the long string casing completion 246, for example, though a fluid line of the rig or long string completion. The fluid pump is operably connected to and controlled by the computer sub-system 254. The sensor and gauges 252 include pressure sensors installed in a pump line of the rig 248. The pressure sensors measure changes in the pumping pressure within the downhole string and/or casing.

The rig 246 also includes a top drive 256 connected to downhole strings, tubings, and/or casing by a drilling line. The top drive 256 is operable to raise or lower strings, tubings, and/or casing in the wellbore 101 by raising or lowering the drilling line. The top drive 256 is operably connected to and controlled by the computer sub-system 254. The top drive 256 can apply loads and/or tensions to the to the drilling line and, when connected directly or indirectly to the drilling line, the stub connector 150. A load cell 258 arranged at a rig floor 260 and is connected to the drilling line. The load cell 258 is operable to measure the load and/or tension applied to the connected downhole strings, tubings, and/or casing by measuring the tension and/or load applied to the drilling line.

The rig 248 includes or is connected to a weight indicator 262 for receiving and displaying the load and tensions measurements sensed by the load cell 258. The load cell 258 is operably connected to the weight indicator 262. The weight indicator 262 displays the string weight (or "hook load") and the downward weight applied (or "weight-on-bit"). The weight indicator 262 is part of the computer sub-system 254, however, some weight indicators are separate from and operably connected to the computer sub-system. In some cases, the load cell is controlled by the weight indicator. The load cell can be operably connected to and controlled by the computer sub-system. The load cell is operably to transmit the measured load and tensions applied to downhole casings, tubings, and/or strings to the computer sub-system and/or weight indicator. The computer sub-system can receive data from the load cell and display the load cell data.

Figure 4A:
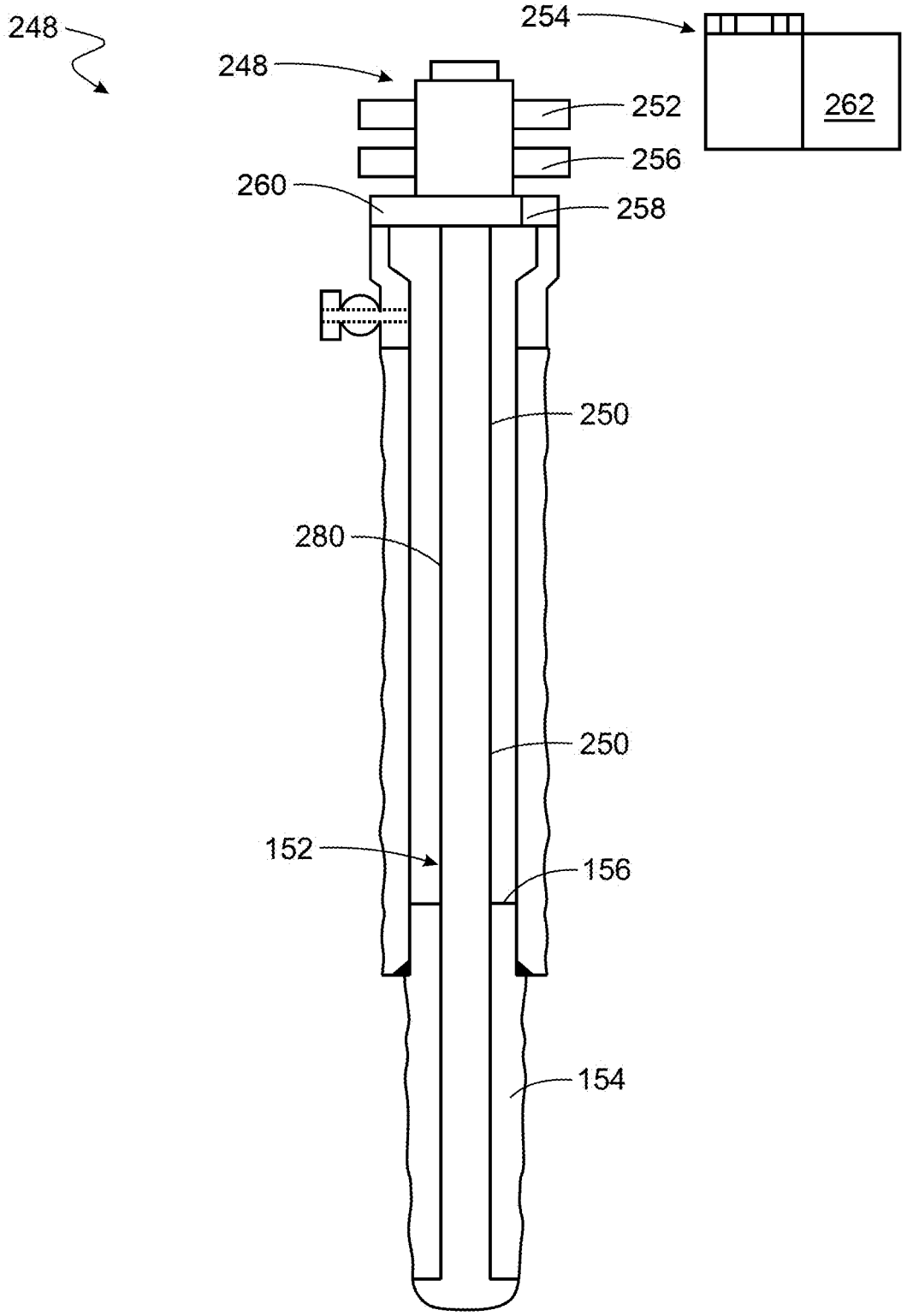
FIG. 4A is a cross-sectional front view of a wellbore with a damaged casing.

FIG. 4A is a cross-sectional front view of the long-string completion 246 with the damaged long-string pipeline 250 in the wellbore 101. After forming the wellbore 101, a long-string completion 246 is formed by running the wellbore casing 116 from the bottom of the wellbore 101 to the surface 114. The long-string completion 246 can be landed at surface 114 using a tubing hanger setting in a tubing spool (not shown) then cemented into the wellbore 101 by the cement column 154. The cement column 154 located in the outside annular space, also extends from the bottom of the wellbore 101 to a known depth within the long-string casing 152.

During subsequent operations, the long-string casing 152 or a portion thereof may become damaged over time, for example corroded or leaking. Damage above the face 156 of the cement column 154 can be remedied using the remedial assembly 102. The damaged portion 250 of the long-string casing 152 can be removed and replaced.

Figure 4B:
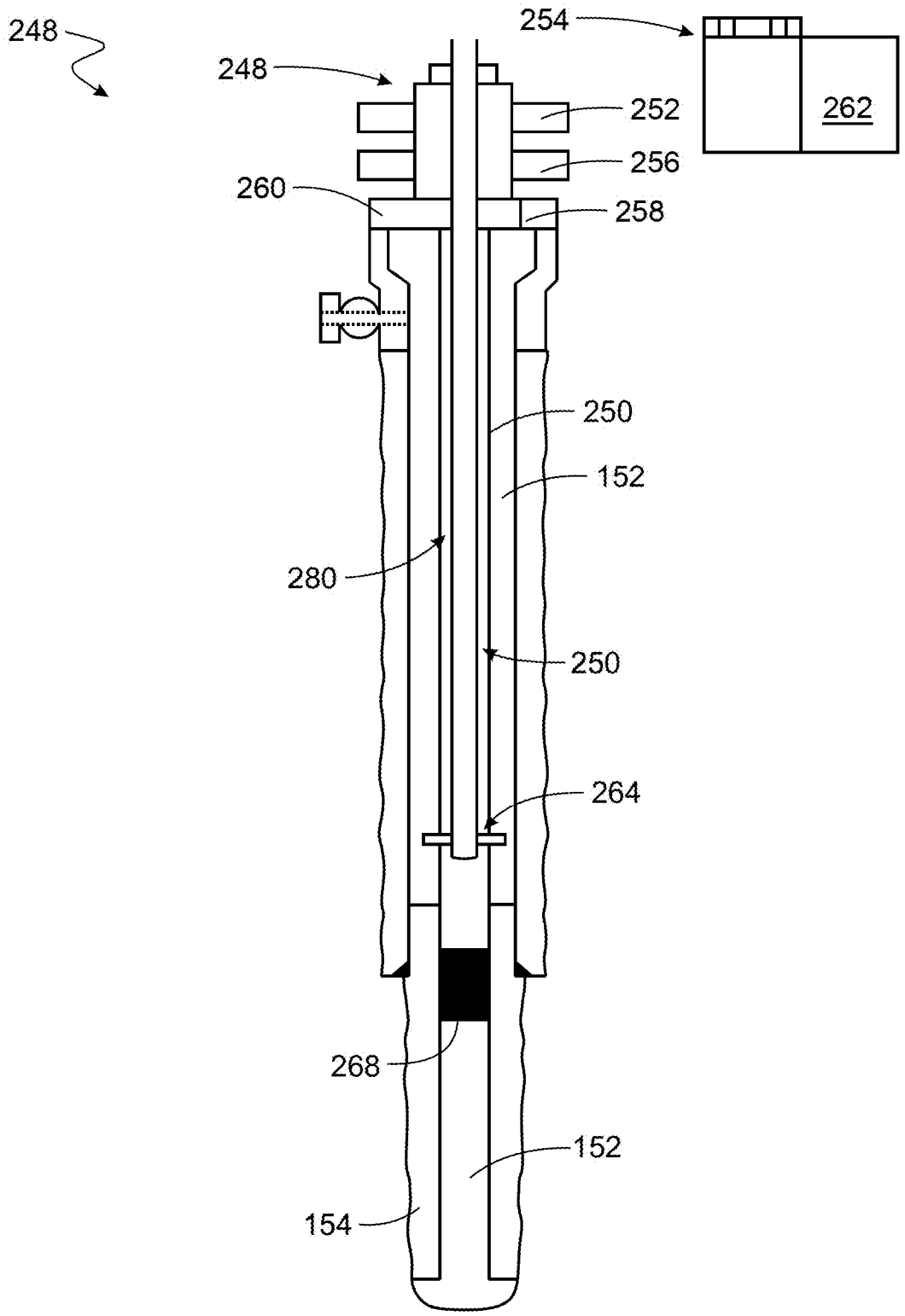
FIGS. 4B and 4C are cross-sectional front views of cutter and milling tools separating the damaged casing and leaving a milled casing stub in the wellbore.
Figure 4C:
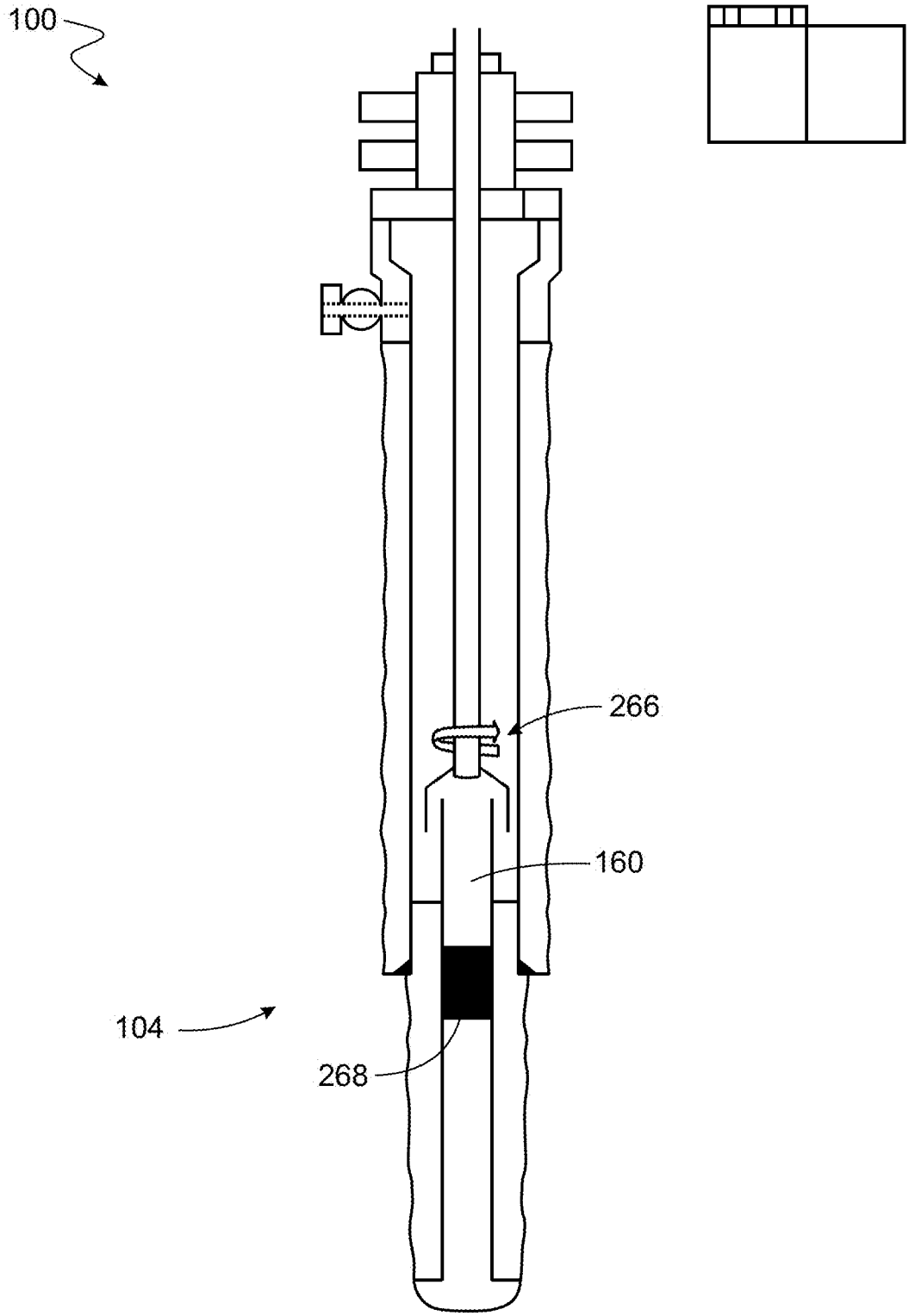

FIGS. 4B and 4C are cross-sectional front views of a cutter 264 and wash over tool 266 (milling assembly, milling tool) for separating the damaged pipeline (casing) 250 and milling the remaining casing stub 160. The well a plug 268 is installed so that the well is ready to undergo cutting operations. The cutter 264 is run in hole and mechanically clean cuts the long-string casing 152 about 3 ft to about 8 feet above the face 156 of the cement column 154. The cut section of the long-string casing 152, with the damaged portions 250, is removed from the wellbore 101, leaving a modified long-string completion 104 with the casing stub 160. The wash over tool 266 is then run-in-hole to dress the remaining casing stub 160 of the long-string casing 152. The wash over tool 266 mills the casing stub 160 to remove sharp edges of the casing stub 160 left by the cutter 264.

Figure 4D:
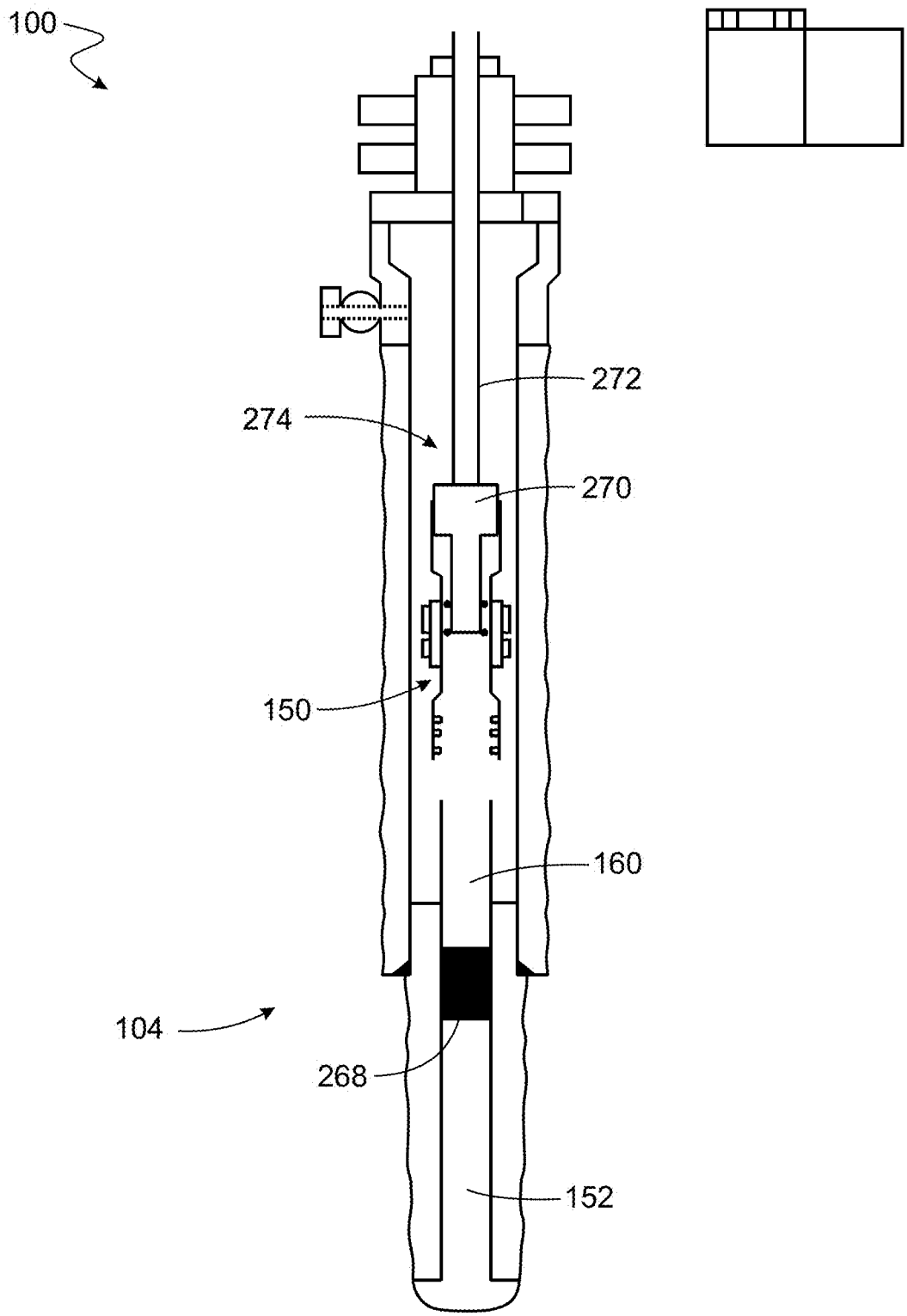
FIG. 4D is a cross-sectional front view of a stub connector mounted to a running tool.

FIG. 4D is a cross-sectional front view of the stub connector 150 mounted to a running tool 270. The running tool 270 releasably connects to the PBR 176 of the stub connector 150 and inserts the connector 150 into the wellbore 101. The attachment arrangement 194 of the overshot section 174 of the connector 150 is in the relaxed position and the anchoring arrangement 194 is in the contracted position. The packer 220 can keep the overshot section 174 centered on the wellbore axis 120 as the casing stub 160 moves into the wellbore 101. As the stub connector 150 approaches the casing stub 160, the running tool 270 stops about 10 ft above the casing stub 160. The changes in the string weight, pumping pressure, and downhole torque are measured by the sensors installed at surface, and are visualized.

Sensors and gauges 252 installed at surface can detect changes downhole. The data can be visualized on surface through computer software, (e.g., by a computer sub-system 254 on the surface). For example, a pressure sensor can be installed at the pump line to measure the changes in the pumping pressure inside the downhole string or casing. The string 274 is raised and lowered by the drilling line connected to the top drive 256 at surface. The load cell 258, installed at the rig floor 260, is connected to the drilling line. The load and tension in the drilling line is measured by the load cell 258. The load cell 258 is connected the weight indicator 262 at the surface. The weight indicator 262 displays the string weight (or "hook load") and the downward weight applied (or "weight-on-bit").

The running tool 270, the connector 150, and a tubing 272 connected to the running tool 270 form a string 274. The tubing 272 is directly or indirectly connected to the top drive 256. The tubing can be the drill line or can be connected to the drill line such that the tubing receives tension and load forces applied by the top drive. The string 274 and the computer sub-system 254 performs calibration operations to determine a baseline up weight, baseline down weight, and baseline neutral weight of the string 274. The baseline weights are displayed by the weight indicator 262. In some cases, the weight indicator determines and displays the baseline weights of the string.

The baseline weights of the string 274 are measured with the string 274 in a neutral position (the neutral weight), as the string 274 moves upwards (uphole) (the up weight, pick up wight), and as the string 274 moves downwards (downhole) (the down weight). In particular, the baseline neutral weight is the weight of the sting under fluid, within the wellbore ("buoyed weight" of the string). The down weight and up weights are measured at surface and displayed in the weight indicator. Both the up wight and the down weight differ from the neutral weight due to the friction effect of the fluids on the string. The pick-up weight is generally higher than the neutral weight. The downwards weight is generally lower than the neutral weight. Both the up weight and the down weight are recorded as baseline weights to determine the overpull and slack off forces to be applied later in the remedial operations. The overpull force is an additional weight to the based pick-up weight. The slack-off force is a further weight decrease to the base downwards weight.

The computer sub-system 254, for example by the weight indicator 262, determines and displays a slack off (downhole) force and an overpull (uphole) force to be applied to the stub connector 150 at a later stage in the connector installation operations. The slack off force is determined based on at least the baseline down weight. The slack off force can also be determined based on at least the force required to fully engage the seal stack 196 and/or the maximum load rating of the seal stack 196. The slips 200 are activated after the seal stack 196 engages with the casing stub 160.

The overpull force can be a fit-for-purpose overpull force. The maximum overpull force the completion 246 can withstand can be determined and modified by the specifications of the components in the completion system 100, wellbore parameters, and production estimates. The overpull force to be applied by the top drive 256 can be determined based on the up weight of the string 274. The overpull force can also be determined based on an estimated overpull force the fluid movement and pressure applies on the completion system during production operations, a bottomhole pressure of formation fluids, and/or an exposed contact area of the body (e.g., the notches in of the connector body that are exposed the formation pressure in the channel 171).

The estimated overpull caused by the formation fluid can be calculated based on the expected formation pressure and actual dimensions of the system. The exposed contact area of the body may be formed where the PBR 176, overshot section 174, and the anchoring arrangement 178 attach, but do not connect seamlessly. The connections between the PBR 176, overshot section 174, and anchoring arrangement 178 may define gaps, notches, pockets, or steps 280 (FIG. 2) that extend axially along the wellbore axis. Production fluid that enters the exposed areas (notches) in the body 162 of the connector 150 can experience an overpull force pressing uphole on the notch.

The production packer is arranged uphole of the overshot section 174 to anchor the stub connector at a known axial location within the wellbore. The anchored stub connector restricts upwards movement during production phase.

The slips 200 uphole of the sealing stack 196 also helps to anchor the stub connector in the known axial location and restrict the upwards movement of the stub connector during production.

The running tool 270 continues to run the stub connector 150 downhole, towards the casing stub 160. As the casing stub 160 enters the guide lip 182, the rim 204 of the stub 160 contacts the seal 198 of in the seal stack 196 closest to the second opening 170 of the connector 150. The computer sub-system 145 prompts the string 274 to apply the determined or known slack off force to attach the connector 150. The seals 198 in the seal stack 196 compress and permit passage of the casing stub 160 further into the overshot section 174. The slack off force is maintained and the connector 150 moves downhole relative to the casing stub 160.

The seal stack 196 passes through the casing stub 160 and radially aligns the with permanent slips 200 of the attachment arrangement 194. The barbs or teeth of the slips 200 affix the casing stub 160 to the connector 150 while the slip 200 is in the disengaged position. The slips 200, mounted to the outer surface of the casing stub 160, move from the disengaged position to the engaged position due to the slack off force. The computer sub-system or surface operator may confirm that the string moved a distance sufficient to fully engage the slip of the connector.

Figure 4E:
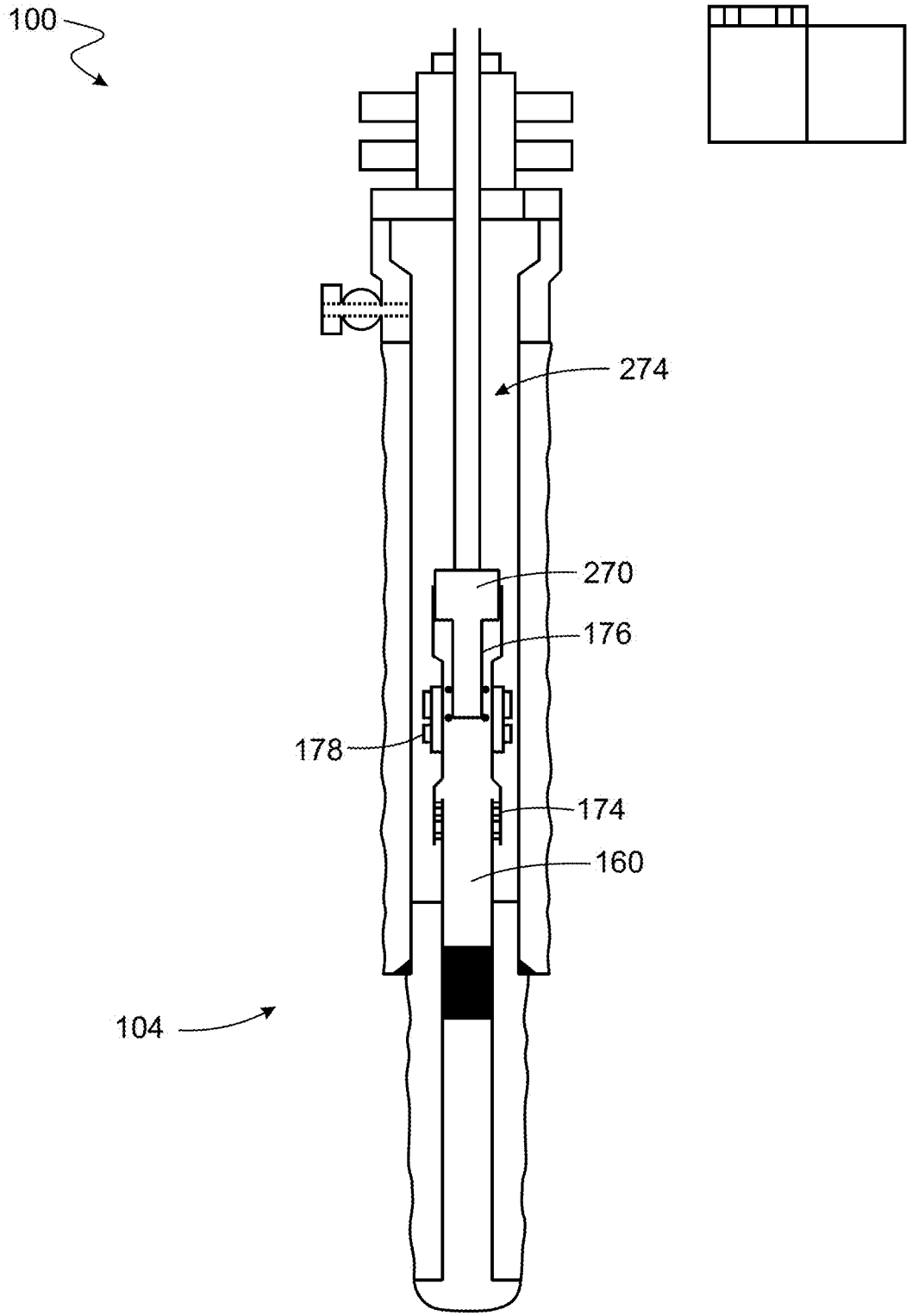
FIG. 4E is a cross-sectional front view of the attached stub connector mounted to the casing stub by the overshot assembly.

FIG. 4E is a cross-sectional front view of the attached stub connector 150 with the overshot section 174 in the attached position. In the attached position, the slip 200 of the stub connector is fully engaged with the casing stub 160 and the seal stack 196 is compressed and in contact with the outer surface of the casing stub 160. The seal stack is capable of maintaining a seal pressures of about 5,000 psi to about 15,000 psi.

Figure 4F:
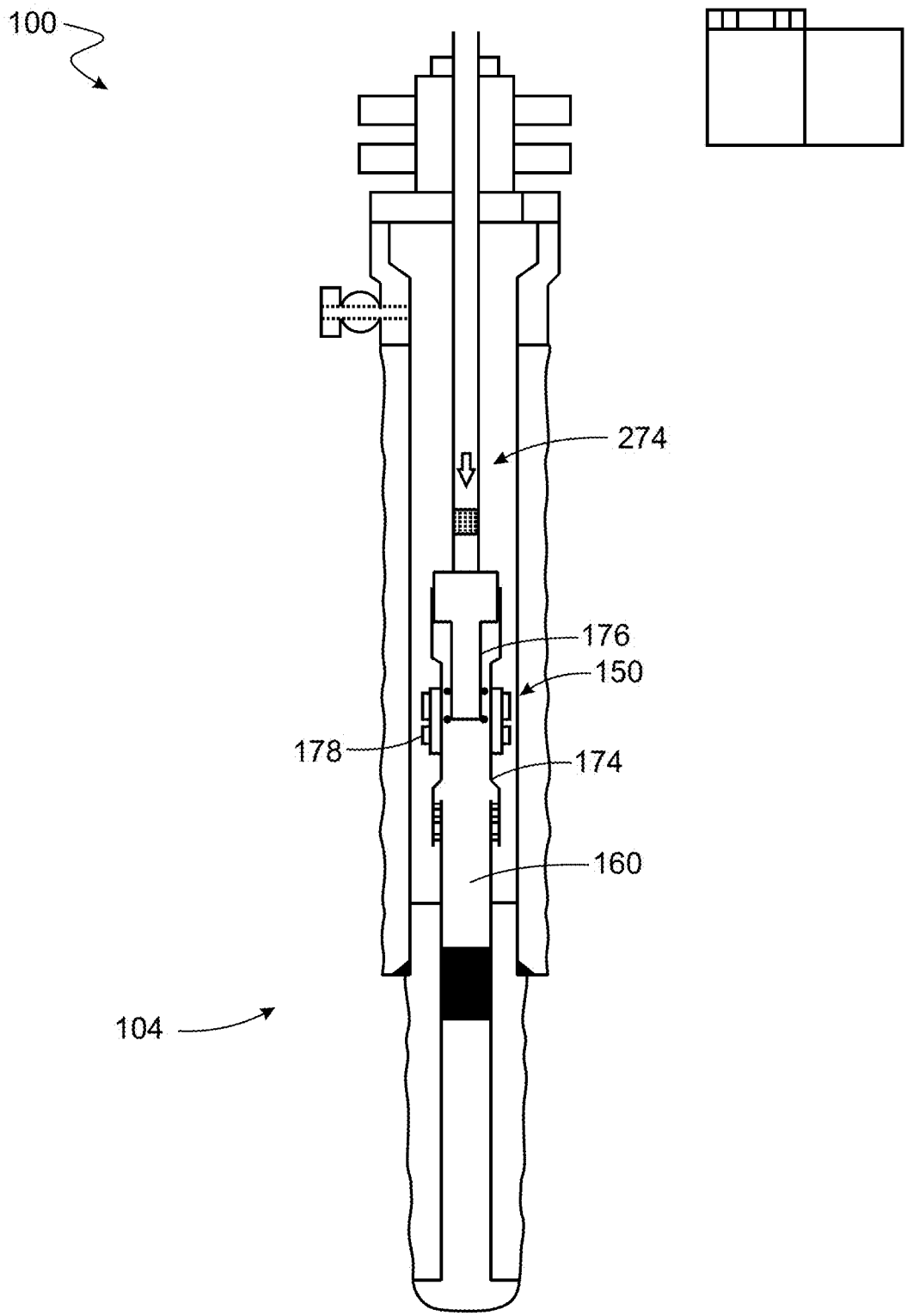
FIGS. 4F and 4G are cross-sectional fronts view of the anchoring arrangement of the attached stub connector in the unanchored and anchored position, respectively.
Figure 4G:
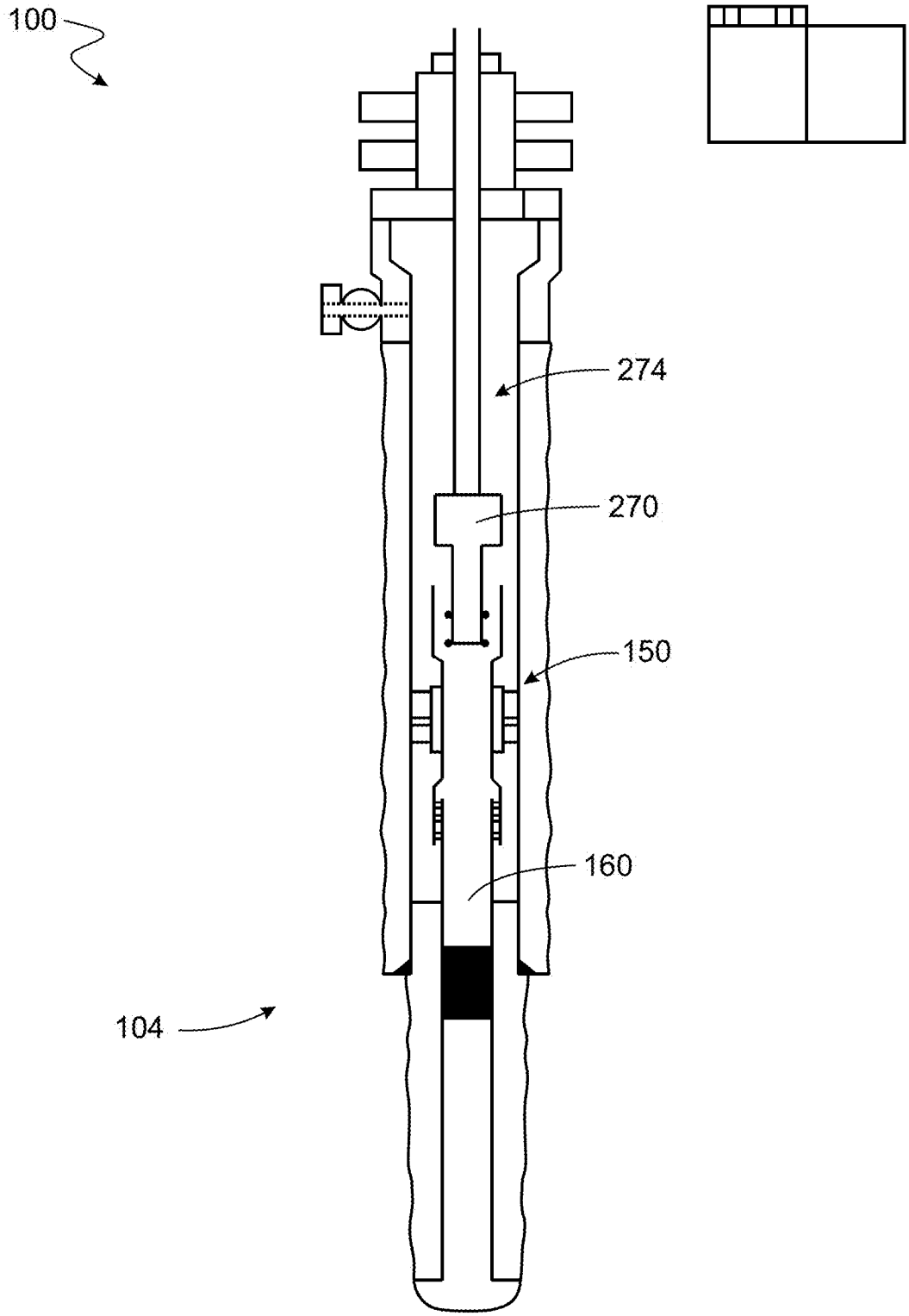

FIGS. 4F and 4G are cross-sectional front views of the anchoring packer 220 of the stub connector 150 in the unanchored and anchored position, respectively. In the attached position, the overshot section 174 axially and rotationally constrains the connector 150 to the casting stub 160. While the connector 150 is attached and unanchored, the computer sub-system can prompt the string 274 to confirm that the slip 200 is in fully engaged with the casing stub 160. The computer sub-system 145 prompts the string 274 to apply the determined overpull force to the connector 150 and, if fully connected, to the casing stub 160. The overpull force (upward load) applied to the connector 150, pulls the connector 150 uphole (towards the first end 164 of the connector 150). Additional pressure tests on the casing and the annulus may be performed to confirm the seals hold under the overpull force.

The connector 150 is anchored to the wellbore casing 116 while the overpull force is maintained by the string 274. The overpull force is about 5 klb to about 10 klb. The packer 220 expands and anchors the stub connector 150 to the wellbore casing 116.

In the anchored position, the packer 220 seals and mounts the connector 150 to the casing wellbore. Pressure tests may be performed to confirm that the seals can hold up to 4,000 psi to about 60,000 psi. Additionally, annulus pressure sets may be used to confirm that the packer 220 is set and fixed to the wellbore casing 116. The overpull force is terminated and the running tool disengages the first end of the connector 150. The running tool is removed from the wellbore 101 while attached-anchored stub connector 150 remains in the wellbore 101.

Figure 4H:
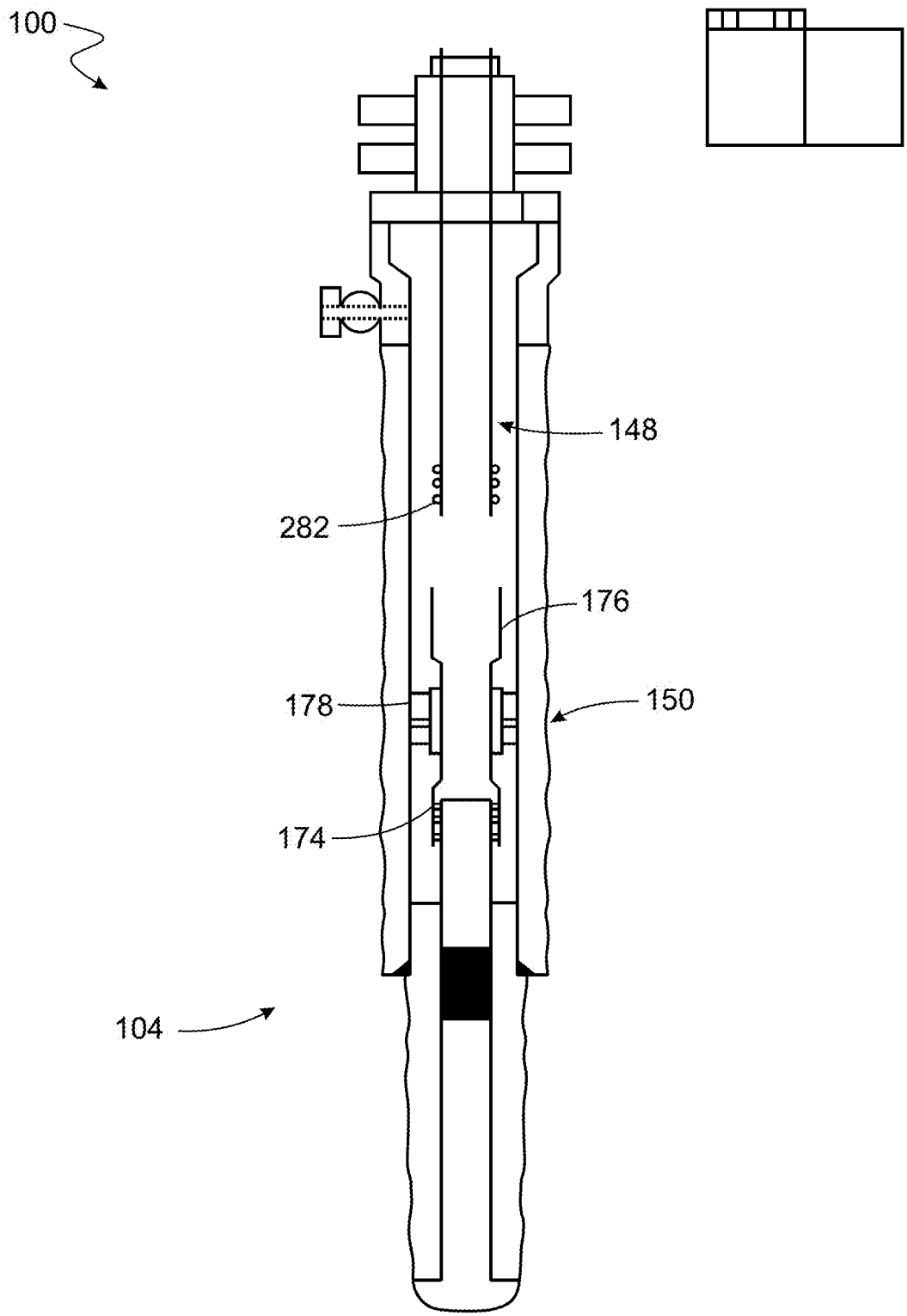
FIG. 4H is a cross-sectional front view of the attached-anchored stub connector mounted to a casing stub and a new casing mounted to a running tool.

FIG. 4H is a cross-sectional front view of the attached-anchored stub connector 150 mounted to the casing stub 160 and a replacement casing 148 mounted to the running tool 270. The replacement casing 148 can include a stinger seal arrangement 282 for connecting the replacement casing 148 with the PBR 176 of the connector 150. The stinger seal arrangement 282 includes a seal assembly (e.g., a system of seals that engages in the sealbore to isolate the production-tubing from the wellbore annulus). The end of the new tubing (replacement casing) has seal assembly that is longer than the sealbore (2 to 5 ft longer). The PBR 176 is a sealbore (e.g., a polished bore designed to accept a seal assembly). After the new casing 148 inserted into the PBR 176, through the first opening 168, the stinger seal arrangement 282 seals and attaches the replacement casing 148 to the connector 150 by engaging the seal assembly at the end of the new casing to the PBR 176 in the stub connector 150. The length of the PBR 176 is sized accommodate the expected casing movement exerted by the formation fluid pressure at the end of the seal assembly.

After sealing the PBR 176 to the replacement casing, the seal can be pressure tested for leaks. The leaks can be detected through annulus side. When testing the annulus side for leaks, the casing is pressurized and the annulus is kept open to detect the leaks. In some cases, the leaks can also be detected through the casing side. When testing the casing side for leaks, the annulus is pressurized and the casing is kept open to detect leaks.

Figure 4I:
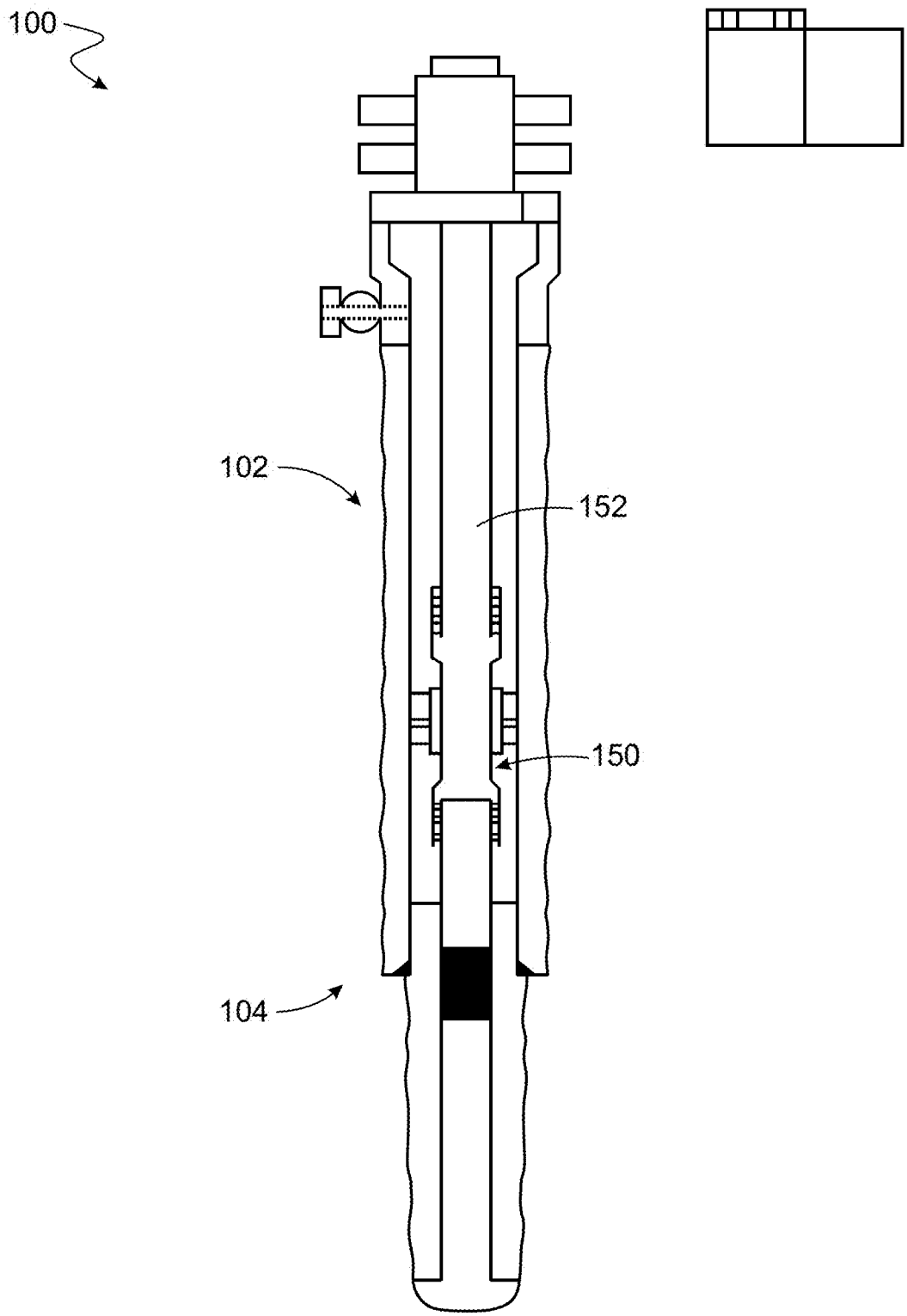
FIG. 4I is a cross-sectional front view of the attached-anchored stub connector sealed to the casing stub and sealed to the new casing.

FIG. 4I is a cross-sectional front view of the attached-anchored stub connector 150 sealed to the casing stub 160 and sealed to the replacement casing 148. The modified long-string completion 104 with the remedial assembly 102 undergoes pressure tests to confirm no leaks are present in the long-string system 100. The system 100 can then proceed with production operations.

Figure 5:
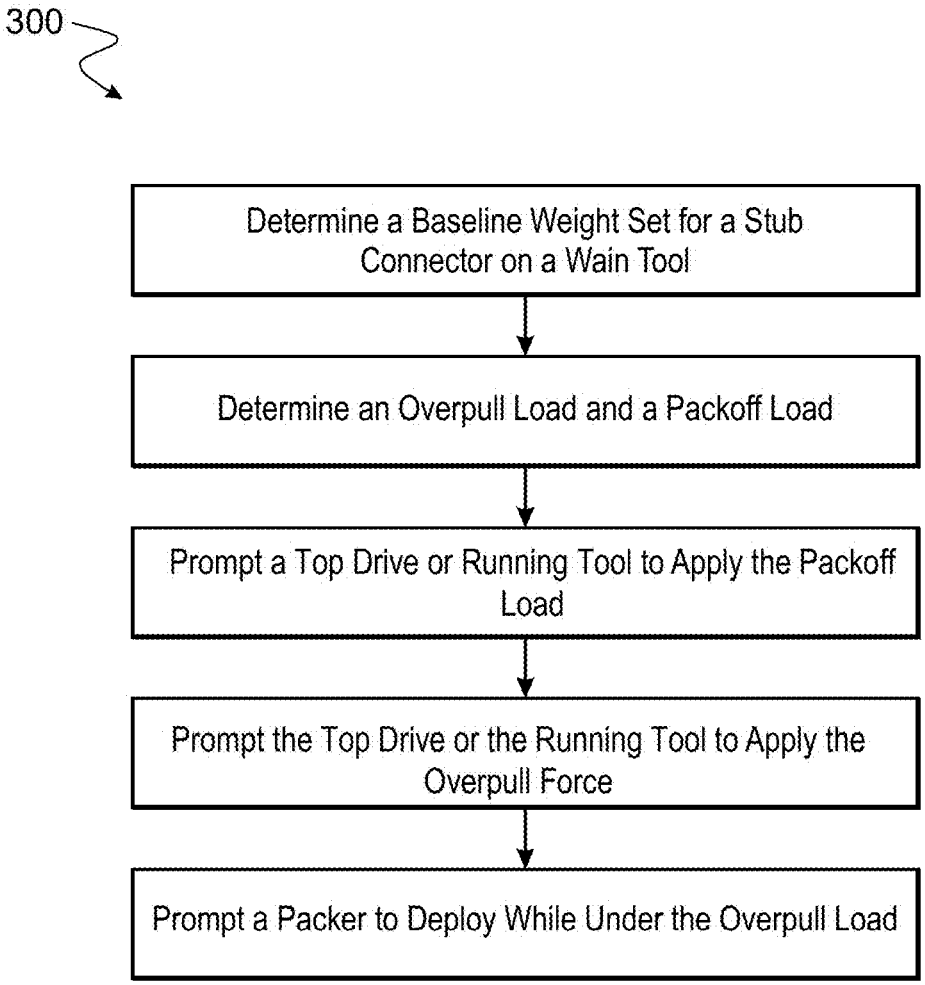
FIG. 5 is a flowchart of a method for installing a stub connector and new casing to a casing stub.

FIG. 5 is a flowchart of a method 300 for installing a stub connector and replacement casing to a milled casing stub of a long-string casing. The method is described with reference to the system 100, however, the method may be used with any long-string completion system.

The method 300 can include forming or drilling a wellbore 101 into a formation, lining the walls 118 of the wellbore 101 with a wellbore casing 116, and preparing a long-string completion 246 in the wellbore (FIG. 4A). The long-string completion 246 is prepared by running the long-string casing 148 from the bottom of the wellbore 101 to the surface 114. The long-string completion 246 can be landed at surface 114 using a tubing hanger setting in a tubing spool (not shown). A lower (downhole, first) part of the long-string casing 152 is cemented by pumping cement through the long-string casing 152, then displacing the cement to an outside annular space between the long-string casing 152 and the walls 118 of the wellbore 101 and/or the wellbore casing 116 using the drilling fluid or completion fluid (brine) with same mud weight as the drilling fluid. The cement column 154 located in the outside annular space, also extends from the bottom of the wellbore 101 to a known depth within the long-string casing 152. The long-string completion 246 is then pressure tested for leaks in the long-string casing 152 before handing the well over for future rigless operations.

During subsequent operations, the long-string casing 152 or a portion thereof may become damaged over time, for example due to corrosion or mechanical damage, resulting in leaks. Damage above the face 156 of the cement column 154 can be remedied using the remedial assembly 102. The damaged portion 250 of the long-string casing 152 can be removed and replaced with the replacement casing 148 of the remedial assembly.

To determine the cut length a casing collar locator (CCL) and cement bond log are run. The well is killed and a plug 268 is installed so that the well is ready to undergo cutting operations. The plug 268 is mounted in long-string casing 152 below (downhole of) the casing stub 160. The method 300 includes, cutting, separating, and removing a damaged portion 250 of a long-string casing 152 of a long-string completion 104 using a cutter 264 and milling tool 266 (FIGS. 4B, 4C), leaving a casing stub 160 extending (protruding) from the face 156 of the cement column 154. The cutter 264 is run in hole and mechanically clean cuts the long-string casing 152 about 3.5 feet to about 5.5 feet above the face 156 of the cement column 154. The cut section of the long-string casing 152, with the damaged portions 250, is removed from the wellbore 101, leaving a modified long-string completion 104 with the casing stub 160. The method includes inserting a milling tool 266 by a running tool to mill the stub 160. Milling the stub smooth sharp edges that may have formed during cutting operations. Smoothing the stub can reduce the risk of the casing stub cutting elastomeric seals in the connector device.

The method 300 also includes attaching the first end 146 of the stub connector 150 to the running tool 270 and running the connector 150 into the wellbore 101 (FIG. 4D). During insertion, the stub connector 150 is unattached and unanchored. The packer may assist the running tool in centering the overshot section on the wellbore axis so that the overshot section is aligned with the casing stub. As the stub connector 150 approaches the casing stub 160, the running tool 270 stops about or within about 10 ft from the casing stub 160 to calibrate the string 274.

The method 300 includes calibrating or determining a set of baseline weights of the string 274, which is formed by at least the running tool 270 and the stub connector 105. The computer subsystem 145 is operably connected to the running tool 270 such that the running tool 270 is controlled by the computer sub-system 254. The set of baseline (calibration) weights include a baseline up weight, baseline down weight, and baseline neutral weight of the string 274. To determine the weights, the computer sub-system 254 prompts the string to move the string uphole, downhole, and to remain static. The computer sub-system 254 and/or the weight indicator 262 and may receive sensor measurement signals from the load cell 258. The signals may be indicative of the baseline weights of the string 274. The computer sub-system 254 can determine the set of baseline weights based on the received signals.

The baseline weights are used to offset the measured weights as the string 274 applies the slack off and overpull loads on the connector 150. As such, the measured weight of the string 274 when applying the slack off load is less than the baseline neutral weight due to the friction the system experience downwards, and it is equal to the difference between of the baseline down weight of the string 274 and the slack off load. Additionally, the measured weight of the string 274 when applying the overpull load is greater than the baseline neutral weight due to the friction the system experience upwards, and it is equal to the sum of baseline up weight of the string 274 and the overpull load. The neutral weight is measured when the string 274 is the neutral (unmoving) position and represents the buoyed weight of the string. The baseline up weight of the string is measured when the string 274 moves upwards (uphole). The down weight of the string 274 is measured when the string 274 moves downwards (downhole).

During calibration, a slack off (push) load and an overpull (pull) load to be applied to the connector 150 is determined by measuring the actual neutral weight, pick up weight, and slack off weight about 5 to 20 ft above the target depth (e.g., casing stub depth in the wellbore). The weights can be measured by the load cell 258 and displayed by the weight indicator 262. The slack off load is a load, force, or compression applied by the string 274 (or running tool) onto the connector 150 in the downhole (first) direction. The slack off load is used to move the overshot section 174 from the unattached position to the attached position. Applying the slack off load to the connector presses the connector 150 onto the casing stub 160 with a force sufficient to compress the seal stack 196 and fully engage the seals 198. The slack off load is about 10,000 bounds (lb). The slack off load (force) is determined based on at least the operating parameters of the seals 198 to prevent damage to the seal stack 198, for example the maximum load rating of the seals and/or the force required to fully engage the seals. If the slips seal stack is able to withstand high slack off force, for example 10,000 to 20,000 lbs, the slack off force may be determined based on the estimated formation pressure or estimated production fluid pressure. The slack off force may be about 5 klb to about 15 klb, for example about 5 klb to about 15 klb or about 10 klb to about 15 klb. In some cases, the slack off load is at least 10 klb or at least 5 klb.

The overpull load is a load, force, or tension applied by the string 274 (or running tool) onto the connector 150 in the uphole (second) direction, opposite the first direction. The overpull load is applied to the connector 150 after the slips 200 are attached to and engages with the casing stub 160 (e.g., after the slack off load has been applied to the connector 150). The overpull load is about 5 klb to about 10 klb. In some cases, the overpull load is based on, at least the baseline up weight.

The overpull load can be customized based on the estimated operational parameters of the well. The overpull load may be used to confirm the full engagement of the slips and sealing packers and to confirm the connector can withstand operational pressures. For example, the overpull load can be determined based on the estimated or measured overpull force of fluid during production operations, an estimated or measured bottomhole pressure of formation fluids, and/or an exposed contact area 280 (steps) of the body 162 (e.g., the exposed thicknesses of the connector body to the formation pressure). The estimated overpull caused by the formation fluid can be calculated based on the expected formation pressure and actual dimensions of the completion system. The exposed contact area 280 (steps) of the body may be formed where the PBR 176, overshot section 174, and the anchoring arrangement 178 attach, but do not connect seamlessly. The connections between the PBR 176, overshot section 174, and anchoring arrangement 178 may define gaps, pockets, notches, or steps 280 (FIG. 2) that extend axially along the wellbore axis. Production fluid can enter the pockets and apply an uphole force to the connection. The determined overpull load may be applied to test the connector In some cases, the overpull force is known. The overpull force can be about 5 klb to about 10 klb. Such an overpull force can provide sufficient force to engage the slips without disengaging or disrupting the seal stack.

After calibrating the baseline weights and determining the slack off and overpull loads, the method 300 includes further inserting the connector 150, by the running tool 270, into the wellbore 101. The string 274 is slacked off slowly to the rim of the casing stub 160. The seal stack 196, with the relaxed diameter is (slightly) smaller than the outer diameter of the casing stub 160. As the casing stub 160 enters the guide lip 182, the rim 204 of the stub 160 contacts the seal 198 of the seal stack 196 closest to the second opening 170 of the connector 150.

The weight of the string as the connector 150 is run in hole is monitored by the load cell 258 at the rig floor 260. The load cell 258 transmits the measured weight to the weight indicator 262 at the surface and/or to a computer sub-system 254 at the surface. Upon contact of the seal stack 196 with the rim 204 of the stub 160, the downward weight of the string 274 will reduce slightly (e.g., by +/−1 klbs). The downward weight of the string 274 is identified by the slight change in the weight measured at the load cell 258 and displayed by the weight indicator 262 at surface, and the depth is marked on the pipe extended above the rig floor 260. To confirm the overshot section 174 is tagging or touching the rim 204 of the casing stub 160, the computer sub-system 254 may prompt a fluid pump to circulate fluid at a low rate, for example 0.1 bbl/min to 1.0 bbl/min. The pressure sensors and gauges 252 installed at the top drive 256 system or a standpipe manifold at surface transmits the pressure inside the string 274 to the computer subsystem 254. The computer sub-system 254 can include monitoring screens and can monitor the pressure of the fluid. An increase in the pumping pressure confirms the alignment and/or contact between the casing stub and the connector.

After contact is confirmed, the computer sub-system 145 prompts the running tool 270 (or string 271) to the slacked off by the determined slack off load. The running tool apples the slack off load to the connector 150. The connector 150 receives the determined slack off load by the running tool 270 and moves downhole, towards the casing stub 160. The seals 198 in the seal stack 196 compress and permit passage of the casing stub 160 further into the overshot section 174. The slack off force is maintained and the connector 150 moves downhole relative to the casing stub 160. From the perspective of the connector 150, the casing stub 160 moves uphole (towards the first end 164 of the connector 150) relative to the overshot section 174. The casing stub 160 passes the seal stack 196 and radially aligns the with permanent slips 200 of the attachment arrangement 194.

The slack of force is applied until the slack off weight (e.g., 10 klbs) is reached and the entire seal stack 196 is engaged with the casing stub 160 and the slips 200 are disengaged. The seal stack 196 is pressure tested to check for leaks in the pressure seal formed between the seal stack 196 and the casing stub 160. If the pressure seal is confirmed, the slips 200 are engaged with the casing stub 160. The engagement of the seal stack 196 can be confirmed by internally pressure testing the string 274 and observing the annulus of the wellbore 101 for any leaks. The confirmation pressure amount applied to the string 274 to confirm the pressurized seal between the seal stack 196 and the casing stub 160 is than a pre-determined shearing pressure sufficient to engage the slips 200. The confirmation pressure applied to the string 274 does not trigger or actuate the slips 200 into moving from the disengaged position to the engaged position. Then the pressure can be increased to shear the shear pins and activate the slips. If a leak is observed in the annulus side, the system can be pulled out and recovered at surface to check the issues and modify as required before running in hole again.

At this point, the seals 196, have been engaged with (mounted to) to the outer surface of the casing stub 160, by downhole movement of the connector 150 relative to the casing stub 160, (or uphole movement of the casing stub 160 relative to the connector 150) and the pressure seal between the engaged seals 196 has been confirmed. The computer sub-system 145 prompts the string or running tool to terminate the slack off load. The connector 150 is static when the slack off load is terminated. The slips 200, are moved from the disengaged position to the engaged position by pressuring up the string to the pre-determined shearing pressure of the slips 200. A predetermined hydraulic pressure is applied to the string 274 and the channel 172 to shear shearing pins in the slips 200. The slips 200 are then moved, by the shearing of the shearing pins and/or by a downhole movement of the stub connector. The slips 200 engage automatically after the shearing pin shears. If properly connected, subsequent test movements (e.g., slight pulling and/or pressing) on the stub connector correspond to sharp increases or decreases in the weight of the string. Confirming the relationship between the test movements and the weight indicates confirms the engagement between the stub connector and the casing stub.

The distance moved by the connector 150 to transition the permanent slip 200 from the disengaged position to the engaged position is a known engagement distance. After slacking off the determined slack off load, the depth of the running tool 270 is determined or measured by the computer sub-system 145 or at the surface by marking the string 274 a second time at the surface (mark 2). The distance between the first depth (mark 1) and the second depth (mark 2) is calculated and compared to the known engagement distance of the slip 200. If the difference is equal to the engagement distance, the slip 200 is fully engaged. If the difference is less than the known engagement difference, the slip 200 is partially engaged.

At this stage in the method 300, the connector 150 is an attached connector (FIG. 4E). The computer sub-system may prompt the system to run pressure test to confirm that the seals form a seal at the desired thresholds. Tests for confirming the seal pressures must be run prior to anchoring the connector with the packer.

The method 300 includes prompting the running tool (or string) to apply the overpull load to the stub connector 150. The overpull load tensions the connector and the stub. The overpull force can be about 5 klb to about 10 klb.

The method 300 also includes anchoring the connector to the wellbore casing 116 while the stub connector 150 and the stub 160 are under tension by the overpull load. Anchoring the connector 150 can include prompting, by the computer sub-system, the packer to deploy while the overpull load is applied. The packer can be hydraulically set. When hydraulically actuated, a retrievable plug or an aluminum ball is run-in-hole, directly below (downhole of) the packer 220. The plug or aluminum ball isolates tools and components downhole of the packer 220 from pressures applied uphole of the ball or plug (e.g., inside of the string directly above the packer setting sleeves). When a predetermined packer pressure from the surface is applied to move the sleeves to set the packer slips 224 of the packers 220, overshot section and corresponding channel 172 do not experience the predetermined packer pressure. The predetermined packer pressure moves the packer 220 from the contracted position to the expanded (anchored) position by pressing the packer slip 224 and seal 221 towards the casing. The plug may then be retrieves or the aluminum ball sheared by apply an additional surface pressure.

At this stage in the method 300, the connector is an attached-anchored connector 150. Additional pressure tests on the casing and the annulus may be performed to confirm the seals hold under the overpull force or after the overpull force is terminated.

The method 300 includes running the replacement casing 148 into the wellbore 101 along the wellbore axis 120 and landing the replacement casing 148 in the PBR 176 (FIGS. 4H and 4I). After the new casing 148 inserted into the PBR 176, through the first opening 168, the stinger seal arrangement is stung out to perform a space out operation. For example, the casing, at a rotary table at the surface, is marked to determine the length when the stinger seal arrangement is fully inside the PBR and the tubing hanger depth at the tubing spool. The stinger seal arrangement is picked up above the PBR mark (+/−5 ft) to finalize the casing location at the surface when the tubing hanger is made up. The stinger seal arrangement is then inserted fully into the PBR then engages to the inner wall of the PBR. In this configuration, when the tubing hanger lands in the tubing spool, the stinger seal assembly downhole is fully inside the PBR in the wellbore. If the marking is too high at the surface, whereas, if the markings are too low, the new casing has been buckled. The excess joints are laid down, and new joints, pup joints are picked up and made up with the tubing spool to have the measured length.

The remedial assembly 102 is fully mounted to the modified long-string completion 104 and forms an isolated fluid path 108 from the long-string casing 152, through the attached-anchored connector 150, and then through the replacement casing 148.

A number of embodiments have been described. Nevertheless, it will be understood that various modifications may be made without departing from the spirit and scope of the disclosure.

While the stub connector has been described as including a permanent packer with separate attachment slips and seals, and some stub connectors include expandable liner hangers rather than or in addition to permanent packers. Expandable liner hangers can both seal and affix the stub connector to the wellbore casing. The expandable liner hanger forms a metal-to-metal seal to affix (attach) the expandable liner hanger to the wellbore and to form a seal between the wellbore casing and the stub connector.

While the anchoring arrangement with a permanent packer 220 has been described as arranged between the PBR 176 and the attachment arrangement 194, some anchoring arrangements are arranged at the second end of the body of the stub connector. In this configuration, the PBR is arranged between the attachment arrangement and the anchoring arrangement. The anchoring arrangement can include a retrievable packer that defines the first opening at the first end. The first opening is sized to receive and pass a replacement casing through the first opening, into a PBR aperture defined by the inner surface of the PBR. The PBR aperture is sized and shaped to receive and connect the replacement casing to the stub connector.

While the overshot section has been described as including a slip and a seal stack, some stub connectors do not include the slips. This configuration may experience higher upwards movement loads applied by the formation pressure as compared to a system with slips in the overshot section. Where the calculated tube (string, casing) movement is not relatively high (e.g., less than or equal to about 3 meters (about 10 feet)), the seal stack can be customized to accommodate the increased movement load. In this configuration, the stub connector is an "attached" stub connector when the seals are engaged with the casing stub. The milled casing stub can prevent or reduce mechanical damage to or scratching of the seal stack during movement or mounting, thereby reducing the risk of breaking the sealed connection between the casing stub and the stub connector even where increased movement may occur. Additionally, the multiple seals (e.g., 5 seals) in the seal stack can prevent or reduce stinging out of the seal stack if mechanical failures occur in the production packer, for example, due to a force the formation pressure exerts on the production packer.

In some cases, the slips have shear pins that shear at a pre-determined applied surface pressure. After shearing, the slips can be pushed towards the wellbore walls (radially outward) by moving the string downwards or upwards. Downhole or uphole movement may be the designated direction for the slips in the sealing overshot. In an exemplary embodiment, the production packer has have two sets of slips. The production packer can include a first set of slips, a second set of slips, and a sealing element arranged between the first and second set of slips. For example, when arranged in a wellbore, the first set of slips can be arranged downhole (below) of the sealing element and the second set of slips can be arranged uphole of (above) the sealing element, after bring sheared at a first predetermined pressure. The first set of slips, arranged below the packer can be engaged or actuated with the downhole (first direction) movement of the casing stub. The second set of slips above the sealing elements are engaged or actuated with the uphole (second direction opposite the first direction) movement of the casing stub, after being sheared at a second predetermined pressure. The first and second predetermined pressures can be the same pressure or can be different pressures. In this configuration, shearing, and/or engagement of each sets of slips can be controlled and/or tested from the surface at various stages. In some cases, the first predetermined pressure is less than the second predetermined pressure. The first predetermined pressure, when applied, shears the shearing pins in slips of the first set of slips. The first set of slips can then be engaged (set), for example by a downhole movement. Where the first predetermined (shearing) pressure is less than the second predetermined, the second predetermined pressure can be applied after setting or engaging the first set of slips to shear the shearing pins in slips in the second set of slips. The second set of slips can then be engaged (set), for example by an uphole movement.

Some stub connectors have a sensor arrangement containing sensors for measuring wellbore parameters and casing stub parameters. For example, the sensor arrangement can include pressure sensors, fluid rate sensors, conductivity sensors, temperature sensors, optical sensors (e.g., cameras), or combinations thereof. The sensor arrangement can be run in and installed into the stub connector, for example between the overshot section and the packer, using a slickline. The casing stub can have an internal profile shaped and sized to accommodate the sensor arrangement. After the sensor arrangement is installed and pressure tested, the sensors in the sensor arrangement are operable to measure, collect, and save measured data. The sensors and/or whole sensor arrangement can be retrieved as needed and the saved measurements (data) downloaded for analysis. Some sensors and/or sensor arrangements are arranged permanently in the casing stub. Permanent sensors and/or sensor arrangements can be arranged uphole of the production packer. In this configuration, the sensor arrangement is arranged at the first end of the stub connector. Other sensor arrangements are installed within a replacement or new casing which attach to the first end of the stub connector. A wire extends from permanent sensor and/or sensor arrangement to the surface to connect the sensor and/or sensor arrangement to a computer sub-system at the surface. In this configuration, the sensor arrangement and/or sensor can provide real-time data and/or analysis of the real time measurement (data) taken by the sensor(s) and/or sensor arrangement. The sensor arrangement is operably connected to and controlled by the computer sub-system. The computer sub-system is operable to receive signals from the sensor arrangement.

While the seals in the seal stacks have been described as molded seals, some seal stacks include at least one seal packer.

Accordingly, other embodiments are within the scope of the following claims.

What is claimed is:

1. A method for deploying an attached-anchored stub connector, the method comprising:
- receiving a slack off force in a first direction of about 5 kilopounds (klbs) to about 15 klb comprising:
  - receiving a milled casing stub in an overshot section of the stub connector, and
  - attaching, by an attachment arrangement of an overshot section of the stub connector, to the casing stub; and
- receiving an overpull force in a second direction opposite the first direction of about 5 klb to about 10 klb comprising:
  - anchoring, by an anchoring packer of the stub connector, to a wellbore casing.

2. The method according to claim 1, wherein attaching, by the attachment arrangement of the overshot section of the stub connector, to the casing stub comprises sealing, by at least one seal of the overshot section of the stub connector, the casing stub to seal the stub connector to an outer surface of the casing stub.

3. The method according to claim 1, wherein attaching, by the attachment arrangement of the overshot section of the stub connector, to the casing stub comprises engaging, by a slip of the overshot section of the stub connector, the casing stub to affix the stub connector to the casing stub.

4. The method according to claim 3, wherein attaching, by the attachment arrangement of the overshot section of the stub connector, to the casing stub comprises sealing, by at least one seal of the overshot section of the stub connector, the casing stub to seal the stub connector to an outer surface of the casing stub.

5. The method according to claim 1, further comprising receiving, by a polished bore receptacle of the stub connector, a long-string replacement casing.

6. The method according to claim 1, wherein the slack off force moves the stub connector towards the unattached casing stub.

7. The method according to claim 1, wherein the overpull force pulls the stub connector away from the attached casing stub.

8. A method comprising:

aligning, by a running tool, a stub connector of a long-string remedial assembly releasably connected to the running tool, applying a slack off force to the stub connector to attach the stub connector to a casing stub, wherein the slack off section comprises a set of deformable seals and a slip, applying an overpull force to the attached stub connector; and maintaining the overpull force while the attached stub connector is anchored to a wellbore casing.

9. The method according to claim 8, wherein the slack off force is about 5 klb to about 15 klb.

10. The method according to claim 8, wherein the overpull force is about 5 klb to about 10 klb.

11. The method according to claim 8, further comprising releasing the overpull force after the stub connector is anchored to the wellbore casing.

12. The method according to claim 8, further comprising releasing engagement with the attached-anchored stub connector.

13. A connection device comprising:

a body extending from a first end to a second end, wherein the first end and second end define a body axis, the body comprising:

an overshot section at the second end, the overshot section comprising:

a guide wall having a lip, wherein the lip defines an opening at the second end of the body, wherein an inner surface of the guide wall at least partially defines a channel extending from the opening towards the first end of the body, and an attachment arrangement comprising:

a seal stack mounted to the inner surface of the guide wall, wherein the seal stack defines an aperture having a seal diameter less than the lip diameter, and a permanent slip mounted to the inner surface of the wall guide wherein the permanent slip defines a hole having a slip diameter less than the lip diameter, wherein the seal stack is arranged between the permanent slip and the opening of the lip;

a polished bore receptacle (PBR) arranged between the first end and the overshot portion; and an anchoring arrangement arranged between the first end and the overshot portion.

14. The connection device according to claim 13, further comprising a computer sub-system comprising:

a controller; and one or more processors, a non-transitory computer-readable medium storing instructions executable by the one or more processors to perform operations, the operations comprising:

determining a slack off load and an overpull load;

prompting a running tool attached to the first end of the stub connector to apply the slack off load; and prompting the running tool attached to the first end of the stub connector to apply the overpull load.

15. The connection device according to claim 14, wherein the operations further comprise determining a baseline weight.

16. The connection device according to claim 14, the operations further comprise: prompting the anchoring arrangement to anchor the stub connector while the overpull load is applied.

17. The connection device according to claim 13, wherein the lip opening, seal aperture, and slip hole are aligned on the body axis.

18. The connection device according to claim 13, wherein the PBR is arranged between the overshot section and the anchoring arrangement.

19. The connection device according to claim 18, wherein the anchoring arrangement comprises a permanent, expandable packer.

20. The connection device according to claim 13, wherein the anchoring arrangement is arranged between the overshot section and the PBR.

21. The connection device according to claim 20, wherein the anchoring arrangement comprises a retrievable, expandable packer.

22. The connection device according to claim 13, wherein the first end defines a first opening sized to receive a replacement casing and the lip opening at the second end is sized to receive a casing stub.

* * * * *